US011795763B2

(12) United States Patent
Marshall et al.

(10) Patent No.: US 11,795,763 B2
(45) Date of Patent: Oct. 24, 2023

(54) DOWNHOLE TOOLS HAVING RADIALLY EXTENDABLE ELEMENTS

(71) Applicant: Schlumberger Technology Corporation, Sugar Land, TX (US)

(72) Inventors: Jonathan D. Marshall, Springville, UT (US); Steven G. Villareal, Houston, TX (US); Michael George Azar, The Woodlands, TX (US); Scott Richard Woolston, Spanish Fork, UT (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 17/346,027

(22) Filed: Jun. 11, 2021

(65) Prior Publication Data

US 2021/0388679 A1 Dec. 16, 2021

Related U.S. Application Data

(60) Provisional application No. 63/037,833, filed on Jun. 11, 2020.

(51) Int. Cl.
*E21B 10/633* (2006.01)
*E21B 10/32* (2006.01)
(Continued)

(52) U.S. Cl.
CPC ..... *E21B 10/55* (2013.01); *E21B 10/322* (2013.01); *E21B 10/633* (2013.01); *E21B 47/01* (2013.01)

(58) Field of Classification Search
CPC ..... E21B 10/265; E21B 10/32; E21B 10/322; E21B 10/325; E21B 47/017; E21B 47/013; E21B 47/0175
See application file for complete search history.

(56) References Cited

U.S. PATENT DOCUMENTS 1,879,226 A 9/1932 Heddy
1,978,006 A 10/1934 Wright
(Continued)

FOREIGN PATENT DOCUMENTS

AU 747625 B2 5/2002
AU 2004274887 A1 3/2005
(Continued)

OTHER PUBLICATIONS

Phillips et al., Deployment of a Self-Adjusting Bit to Solve Todays Drilling Vibration Challenges and Optimize Performance, SPE-187370-MS, SPE Annual Technical Conference and Exhibition, San Antonio, Texas, USA, Oct. 2017, 10 pages.
(Continued)

*Primary Examiner* — Blake Michener

(57) ABSTRACT

A downhole drilling tool, forming part of a subterranean drilling system, may include at least one plate secured to an exterior of an elongate body. Electronics may be disposed between the plate and the body to be protected by the plate while still readily accessible. A dynamic element may be radially extendable from the plate to engage an inner wall of a borehole being drilled. If this radially-extendable element becomes worn or damaged from this engagement, the plate may be replaced. More expensive components of the drilling tool may be contained within the elongate body, rather than the plate, thus reducing replacement frequency. Additionally, plates including unique features may be employed at different times without altering the underlying elongate body.

20 Claims, 21 Drawing Sheets

(51) Int. Cl.
*E21B 47/01* (2012.01)
*E21B 10/55* (2006.01)

(56) References Cited

U.S. PATENT DOCUMENTS 2,198,849 A 4/1940 Waxler
2,317,010 A 4/1943 Wingard
3,024,855 A 3/1962 Kellner
3,664,755 A 5/1972 Carns
3,974,886 A 8/1976 Blake, Jr.
4,211,292 A 7/1980 Evans
4,262,758 A 4/1981 Evans
4,382,477 A 5/1983 Barr
4,386,669 A 6/1983 Evans
4,416,339 A 11/1983 Baker et al.
4,512,425 A * 4/1985 Brock ..... E21B 7/28 175/430
4,690,229 A 9/1987 Raney
4,828,050 A 5/1989 Hashimoto
4,842,083 A * 6/1989 Raney ..... E21B 10/60 175/408
4,856,601 A * 8/1989 Raney ..... E21B 10/60 175/417
5,038,872 A 8/1991 Shirley
5,148,880 A 9/1992 Lee et al.
5,343,964 A 9/1994 Leroy
5,357,979 A 10/1994 Imran
5,361,859 A 11/1994 Tibbitts
5,388,649 A 2/1995 Ilomaki
5,419,405 A * 5/1995 Patton ..... E21B 44/00 175/45
5,553,678 A 9/1996 Barr
5,582,260 A 12/1996 Murer et al.
5,595,254 A 1/1997 Tibbitts
5,778,992 A 7/1998 Fuller
5,931,239 A * 8/1999 Schuh ..... E21B 7/062 175/325.3
6,142,250 A 11/2000 Griffin et al.
6,484,819 B1 11/2002 Harrison
6,540,032 B1 * 4/2003 Krueger ..... E21B 41/0085 175/320
6,607,045 B2 8/2003 Beyerl
6,626,251 B1 9/2003 Sullivan et al.
6,659,201 B2 12/2003 Head et al.
6,691,804 B2 2/2004 Harrison
6,845,826 B1 1/2005 Feld et al.
6,971,459 B2 * 12/2005 Raney ..... E21B 10/43 175/406
7,168,510 B2 1/2007 Boyle et al.
7,207,398 B2 4/2007 Runia et al.
7,510,026 B2 3/2009 Pastusek et al.
7,513,318 B2 4/2009 Underwood et al.
7,610,970 B2 11/2009 Sihler et al.
7,802,637 B2 9/2010 Aronstam et al.
7,810,585 B2 10/2010 Downton
7,849,936 B2 12/2010 Hutton
7,931,098 B2 4/2011 Aronstam et al.
7,942,214 B2 5/2011 Johnson et al.
7,946,357 B2 5/2011 Trinh et al.
8,061,455 B2 11/2011 Beuershausen
8,087,479 B2 * 1/2012 Kulkarni ..... E21B 7/064 175/73
8,141,657 B2 3/2012 Hutton
8,162,077 B2 4/2012 Glasgow et al.
8,196,679 B2 * 6/2012 Radford ..... E21B 4/00 175/57
8,307,914 B2 11/2012 Pafitis et al.
8,365,820 B2 2/2013 Hall et al.
8,469,117 B2 6/2013 Pafitis et al.
8,479,820 B2 * 7/2013 Kaul ..... E21B 36/001 166/57
8,550,190 B2 10/2013 Hall et al.
8,590,638 B2 11/2013 Downton
8,640,768 B2 2/2014 Hall et al.
8,727,036 B2 5/2014 Johnson
8,875,810 B2 11/2014 Meister et al.
8,893,822 B2 11/2014 Trinh et al.
8,919,459 B2 12/2014 Polyntsev
8,960,328 B2 2/2015 Herberg et al.
9,043,152 B2 5/2015 Schuberth et al.
9,080,387 B2 7/2015 Schulte et al.
9,103,175 B2 8/2015 Schwefe
9,140,074 B2 9/2015 Schwefe et al.
9,145,736 B2 9/2015 Peter et al.
9,181,756 B2 11/2015 Schwefe et al.
9,187,959 B2 * 11/2015 Treviranus ..... E21B 47/12
9,206,644 B2 12/2015 Clark et al.
9,217,299 B2 12/2015 Moriarty et al.
9,217,323 B2 * 12/2015 Clark ..... E21B 10/32
9,238,958 B2 1/2016 Teodorescu
9,255,449 B2 2/2016 Schwefe et al.
9,255,450 B2 2/2016 Jain et al.
9,267,329 B2 2/2016 Bilen
9,279,293 B2 3/2016 Izbinski
9,279,903 B2 3/2016 Wassell et al.
9,624,727 B1 4/2017 Hutton
9,708,859 B2 7/2017 Jain et al.
9,790,749 B2 10/2017 Chen
9,863,188 B2 1/2018 Elshafei et al.
9,951,606 B2 4/2018 Ariaratnam et al.
9,970,239 B2 5/2018 Oesterberg
10,041,305 B2 8/2018 Jain
10,094,174 B2 10/2018 Jain et al.
10,113,363 B2 * 10/2018 Cobern ..... E21B 47/024
10,119,338 B2 11/2018 Thomas et al.
10,577,917 B2 3/2020 Marshall
10,633,923 B2 4/2020 Downton
10,669,786 B2 * 6/2020 Marshall ..... E21B 7/064
10,837,234 B2 * 11/2020 Marshall ..... E21B 7/06
11,002,077 B2 5/2021 Woolston
11,053,961 B2 * 7/2021 Marshall ..... F15B 15/24
11,220,865 B2 1/2022 Hall et al.
2002/0056574 A1 * 5/2002 Harvey ..... E21B 23/04 175/320
2004/0222022 A1 * 11/2004 Nevlud ..... E21B 10/322 166/266
2004/0238221 A1 12/2004 Runia et al.
2004/0256113 A1 * 12/2004 LoGiudice ..... E21B 41/00 166/381
2005/0056463 A1 3/2005 Aronstam et al.
2005/0197778 A1 9/2005 Downton
2006/0086536 A1 4/2006 Boyle et al.
2006/0157281 A1 7/2006 Downton
2006/0243487 A1 * 11/2006 Turner ..... E21B 7/068 175/26
2007/0029112 A1 2/2007 Li et al.
2008/0264647 A1 10/2008 Li
2009/0044977 A1 2/2009 Johnson et al.
2009/0044978 A1 2/2009 Johnson et al.
2009/0044979 A1 * 2/2009 Johnson ..... E21B 7/06 175/24
2009/0044980 A1 2/2009 Sheppard et al.
2009/0044981 A1 2/2009 Sheppard et al.
2009/0065262 A1 3/2009 Downton
2009/0107722 A1 4/2009 Chen et al.
2009/0188720 A1 7/2009 Johnson et al.
2009/0194334 A1 8/2009 Johnson et al.
2010/0006341 A1 1/2010 Downton
2010/0025116 A1 * 2/2010 Hutton ..... E21B 7/064 175/76
2010/0038139 A1 2/2010 Johnson et al.
2010/0038140 A1 2/2010 Johnson et al.
2010/0038141 A1 2/2010 Johnson et al.
2010/0101864 A1 4/2010 Sindt et al.
2010/0282511 A1 * 11/2010 Maranuk ..... E21B 10/32 175/344
2012/0012398 A1 * 1/2012 Hall ..... E21B 10/32 175/230
2012/0018224 A1 1/2012 Johnson et al.
2012/0067648 A1 3/2012 Downton
2012/0080235 A1 4/2012 Sheppard et al.
2012/0090897 A1 4/2012 Johnson et al.

(56) References Cited

U.S. PATENT DOCUMENTS

| | | | | |
|---|---|---|---|---|
| 2015/0152723 | A1* | 6/2015 | Hay | E21B 12/00 175/17 |
| 2015/0226009 | A1* | 8/2015 | Claudey | E21B 10/32 175/78 |
| 2015/0240563 | A1 | 8/2015 | Wiercigroch | |
| 2016/0053551 | A1 | 2/2016 | Jain et al. | |
| 2016/0084007 | A1* | 3/2016 | Sugiura | E21B 10/322 175/76 |
| 2016/0108679 | A1 | 4/2016 | Bayliss | |
| 2016/0160567 | A1 | 6/2016 | Downton | |
| 2017/0108039 | A1 | 4/2017 | Hall et al. | |
| 2017/0175455 | A1 | 6/2017 | Jain et al. | |
| 2017/0198525 | A1 | 7/2017 | Feddema et al. | |
| 2017/0234071 | A1 | 8/2017 | Spatz et al. | |
| 2017/0350197 | A1 | 12/2017 | Sugiura et al. | |
| 2018/0016846 | A1 | 1/2018 | Peter et al. | |
| 2018/0030785 | A1 | 2/2018 | Jeffryes | |
| 2018/0106922 | A1* | 4/2018 | Leuenberger | G01V 1/52 |
| 2018/0179884 | A1 | 6/2018 | Doelalikar et al. | |
| 2018/0180418 | A1 | 6/2018 | Estes et al. | |
| 2018/0258705 | A1 | 9/2018 | Oesterberg | |
| 2019/0271193 | A1* | 9/2019 | Peters | E21B 47/14 |
| 2019/0271227 | A1* | 9/2019 | Peters | E21B 41/0085 |
| 2020/0392829 | A1* | 12/2020 | Marshall | E21B 7/28 |
| 2022/0205356 | A1* | 6/2022 | Brackin | E21B 17/1092 |

FOREIGN PATENT DOCUMENTS

| | | | |
|---|---|---|---|
| EP | 0225101 | A2 | 6/1987 |
| EP | 728909 | A2 | 8/1996 |
| EP | 900917 | A1 | 3/1999 |
| GB | 2183694 | A | 6/1987 |
| GB | 2408757 | A | 6/2005 |
| GB | 2422388 | A | 7/2006 |
| GB | 2428713 | A | 2/2007 |
| GB | 2444817 | A | 6/2008 |
| WO | 2005028805 | A1 | 3/2005 |
| WO | 2015117151 | A2 | 8/2015 |
| WO | 2016160637 | A1 | 10/2016 |
| WO | 2018005402 | A1 | 1/2018 |
| WO | 2018063542 | A1 | 4/2018 |

OTHER PUBLICATIONS

Greenwood, J. A., Directional Control and Rathole Elimination While Underreaming Depleted Formations With a Rotary-Steerable System, SPE-187098-MS, SPE Drilling/Completion, 33 (03), pp. 252-258.

* cited by examiner

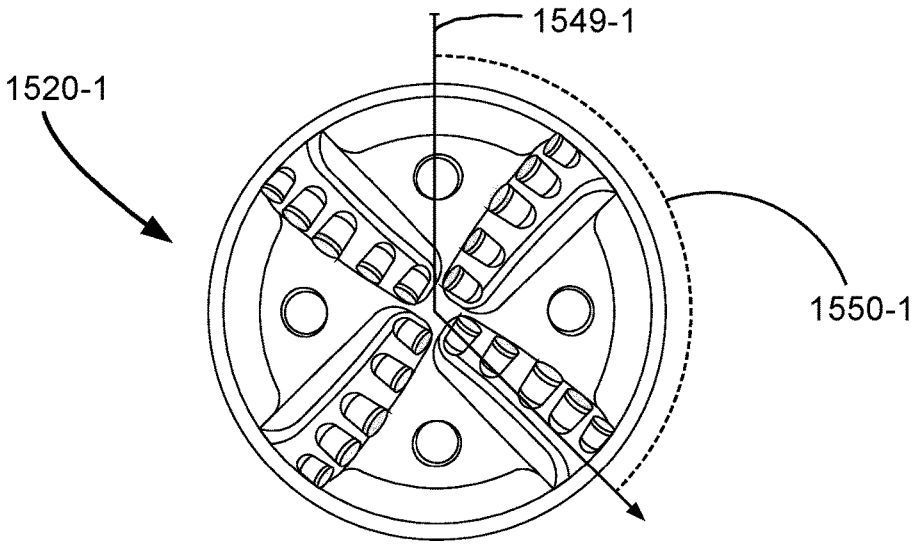
Fig. *11-1*
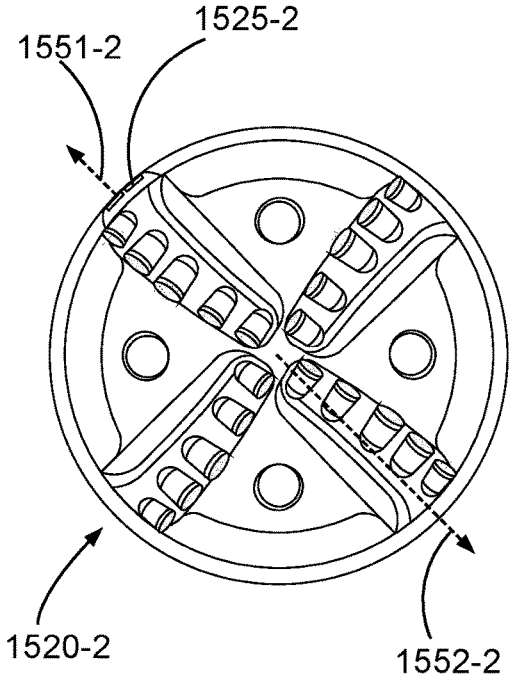
Fig. *11-2*
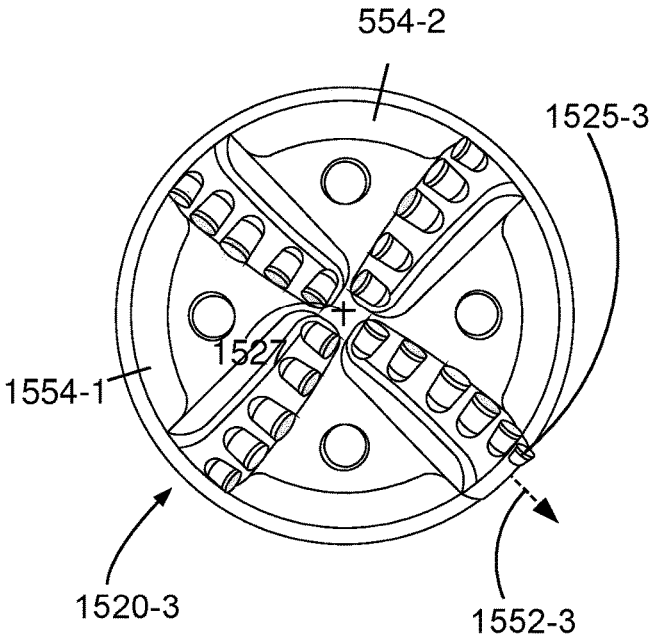
Fig. *11-3*

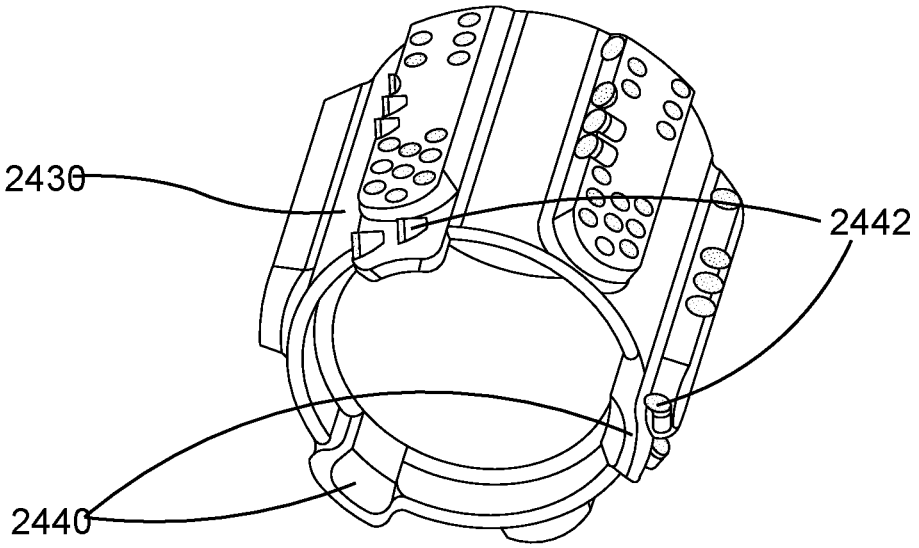
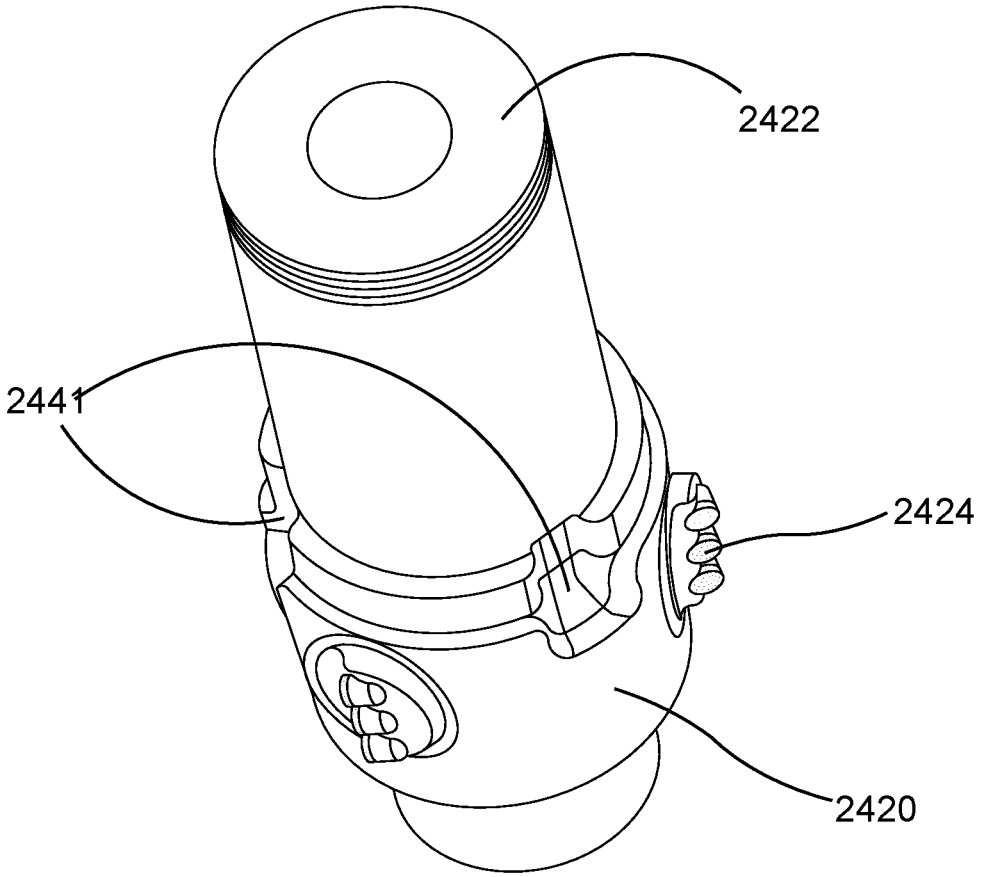
Fig. 14

DOWNHOLE TOOLS HAVING RADIALLY EXTENDABLE ELEMENTS

CROSS-REFERENCE TO RELATED APPLICATION

This application claims the benefit of, and priority to, U.S. Patent Application No. 63/037,833 entitled "Plate-Based Downhole Tool" filed Jun. 11, 2020, which is incorporated herein by this reference in its entirety.

BACKGROUND

When exploring for or extracting subterranean resources, such as oil, gas, or geothermal energy, and in similar endeavors, it is common to form boreholes in the earth. Such boreholes may be formed by engaging the earth with a rotating drill bit capable of degrading tough subterranean materials. As rotation continues the borehole may elongate and the drill bit may be fed into it on the end of a drill string. Drill strings of this type are often formed from a series of pipe sections connected one to another, end to end. Such pipe sections may convey pressurized drilling fluid from the surface of the earth to the drill bit where it may be ejected, thus cooling the drill bit and carrying loose cuttings back to the surface.

At times it may be desirable to alter a direction in which the drill bit is traveling. This may be to steer the drill bit toward valuable resources, away from obstacles, or merely to correct for accidental deviations from its intended trajectory. A variety of mechanisms and techniques have been devised to accomplish such steering. One of the simplest mechanisms includes a bent section of pipe forming part of the drill string, not far from the drill bit, and a motor, commonly powered by the drilling fluid, capable of rotating the drill bit relative to a remainder of the drill string. When the drill string is rotated from the surface the bent section of pipe fails to create a consistent bend in the borehole being formed. However, when the drill string is held rotationally stationary at the surface, and the drill bit is rotated only by the motor, the bent section may offset formation of the borehole in a direction of the bend. Thus, an operator may rotate the drill string when desiring to drill straight and hold the same stationary, in a certain rotational orientation, when desiring to steer. While simple in both fabrication and operation, these bent-pipe systems may receive significant wear while the bent section is rotating within a straight borehole.

More complex mechanisms meant to deliberately steer a drill bit in a chosen direction may include movable parts secured at certain points along a drill string. While the drill string is rotated from the surface, these movable parts may be extended and retracted at various rotational orientations. In one example, when a drill string is positioned in a certain rotational orientation, a movable part may be extended therefrom to push off an inner wall of a borehole and urge the drill bit in an opposite direction. The movable part may then be retracted when the drill string is rotated into another rotational orientation. In another example, a movable part may be extended from a drill string at certain rotational orientations to dig into an inner wall of a borehole and retracted at others, easing the way for a drill bit to steer in those directions. The steering system and components thereof may experience significant wear, thereby decreasing the usable life of the system.

SUMMARY

A downhole drilling tool, forming part of a subterranean drilling system, may include at least one plate secured to an elongate body. In some embodiments, multiple plates may be secured to the elongate body, spaced circumferentially thereabout. Such plates may be secured to the elongate body by any of a variety of methods, such as brazing, welding, bolting to the elongate body, bolting to at least one other plate through the elongate body, mating geometries, or interlocking geometries.

A dynamic element, forming part of the plate, may be radially extendable therefrom. In various embodiments, this dynamic element may extend under pressure from drilling fluid traveling through the elongate body and temporarily held within a cavity formed between the plate and the body. In some embodiments, extension of this dynamic element may push against an inner wall of a surrounding borehole to urge the tool in an opposite direction. In other embodiments, the dynamic element may include at least one cutting element exposed thereon to dig into the inner wall. In yet other embodiments, the dynamic element may include at least one sensor housed therein that may benefit from being pressed against the borehole inner wall.

If this radially-extendable element becomes worn or damaged due to this pushing or digging, the plate may be replaced. More expensive components of the downhole tool may be contained within the elongate body, rather than the plate, thus reducing replacement frequency.

Electronics, capable of controlling extension of the dynamic element or sensing subterranean conditions for example, may be disposed between the plate and the elongate body such that they are protected by the plate yet easily accessible. Such electronics may be attached to either an exterior of the elongate body, to a base of the plate or both. Such electronics, or those located elsewhere, may allow the plate to communicate wirelessly with the elongate body. This communication may, for example, allow for the elongate body to be a direct extension of the dynamic element or receive output from sensors housed within the plate.

In some embodiments, the plate may be detachable from the elongate body and subsequently attachable to a docking station. The same electronics, that allowed for wireless communication with the elongate body, may then allow the plate to communicate wirelessly with the docking station. This communication may allow for a variety of processes such as: diagnostically testing a processor, transferring data to or from data storage of the electronics, reprogramming data storage, or recharging a battery of the plate.

Such a plate-based arrangement may allow for multiple plates, each including unique features, to be employed at different times without altering the underlying elongate body. For example, when dealing with differently sized boreholes one of a plurality of plates, each including at least one cutting element exposed at a unique maximum radial dimension, may be selected based on the size of the specific borehole being drilled.

Further, in some embodiments, a valve, capable of directing extension of the dynamic element for example, may be secured to an exterior of the elongate body with at least a portion of the valve being engaged within the plate. Such an arrangement may allow for the valve to be replaced along with the plate. In some embodiments, a nozzle, passing from an interior of the elongate body to an exterior thereof, may be directed toward the plate to clean and lubricate the dynamic element.

BRIEF DESCRIPTION OF THE DRAWINGS

FIG. 3 is a longitude-sectional view and FIGS. 3-1, 3-2 and 3-3 are cross-sectional views of other embodiments of drilling tools each including an elongate body and a plurality of plates secured to an exterior of the body.

FIG. 4-1 is a longitude-sectional view of embodiments of a plate and a valve that could form part of a drilling tool.

FIG. 7-1 shows an orthogonal view of an embodiment of a plate that may be detached from an elongate body. FIG. 7-2 shows a perspective view of an embodiment of the plate being attached to a docking station.

FIGS. 10-1 and 10-2 are orthogonal views of yet another embodiment of a downhole tool highlighting a method for steering such a tool.

FIG. 11-1 is an orthogonal view of an embodiment of a first step of a downhole steering method.

FIG. 11-2 is an orthogonal view of an embodiment of a second step of a downhole steering method.

FIG. 11-3 is an orthogonal view of another embodiment of a second step of a downhole steering method.

FIG. 14 is a perspective view of embodiments of an elongate body and a hollow sleeve that could form part of a drilling tool.

FIG. 20-1 is a perspective view of an embodiment of an elongate body.

FIG. 20-2 is a perspective view of an embodiment of a hollow sleeve.

DETAILED DESCRIPTION

Figure 1:
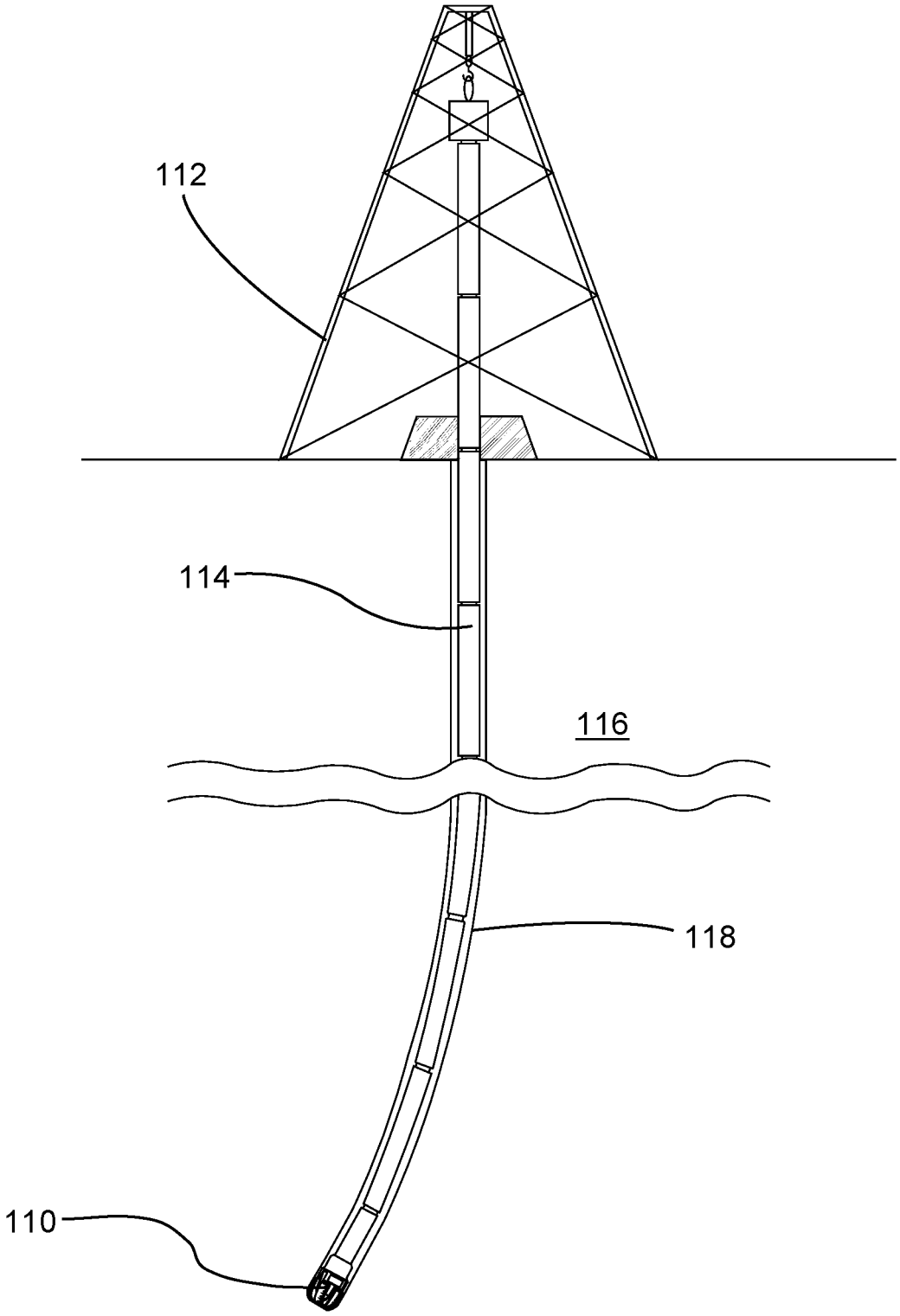
FIG. 1 is an orthogonal view of an embodiment of a subterranean drilling operation.

Referring now to the figures, FIG. 1 shows an embodiment of a subterranean drilling operation of the type commonly used to form boreholes in the earth. More specifically, a drill bit 110 is shown that may be suspended from a derrick 112 by a drill string 114. While a land-based derrick 112 is depicted, comparable water-based structures are also common. As the drill bit 110 is rotated, either with torque from the derrick 112, passed through the drill string 114, or by a downhole motor on the drill string 114, it may engage and degrade a subterranean formation 116 to form a borehole 118 therethrough.

Embodiments described in detail below relate to various drilling tools having one or more radially extendable elements (e.g., dynamic elements, pistons) and a steering gauge. The drilling tools having the radially extendable elements and steering gauge are to be positioned toward a downhole end of the drill string 114. A pilot bit having a diameter less than a predetermined final hole diameter is coupled directly to or proximate to the downhole tool having the radially extendable elements and steering gauge. As discussed below, the radially extendable elements may be axially spaced from the pilot bit less than 5, 4, 3, or 2 times the bit radius. The radially extendable elements may extend less than 25 percent, less than 10 percent, or less than 7 percent of the bit radius. In some embodiments, the radially extendable elements may extend less than 1 inch, less than 0.5 inches, or less than 0.25 inches. In some embodiments, the pilot bit has a box connection that facilitates the positioning the radially extendable elements nearer to the pilot bit. To steer the drill bit and drilling tool in a desired direction, the radially extendable elements may be controlled to extend during selected arcs of the rotation of the drill string. For example, the pistons may be controlled to extend from a retracted position for arcs between 200 to 280 degrees, 220 to 270 degrees, or 240 to 260 degrees of rotation.

Extendable Elements from Drilling Tool with Replaceable Plate

Figure 2:
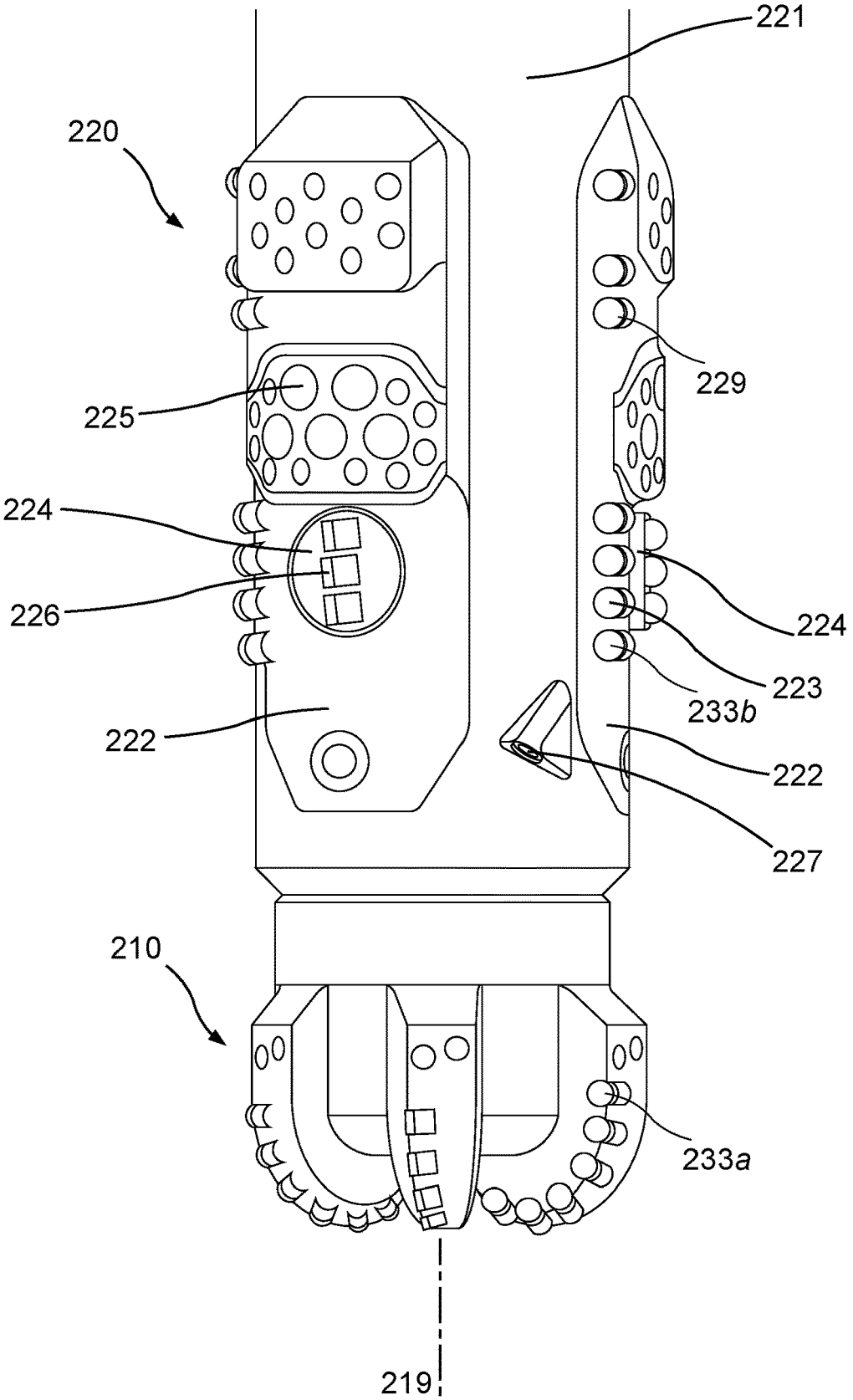
FIG. 2 is an orthogonal view of an embodiment of a drilling tool that could form part of a subterranean drilling operation.

FIG. 2 shows an embodiment of a drilling tool 220 that could form part of a subterranean drilling operation as just described. In the embodiment shown, the drilling tool 220 is disposed immediately adjacent a drill bit 210, however in alternate embodiments such a drilling tool may be placed at other positions along a length of a drill string. The drill bit 210 and the drilling tool 220 rotate about the bit axis 219. The drilling tool 220 may have an elongate body 221 and at least one plate 222 secured to an exterior of the elongate body 221. In the embodiment shown, this plate 222 may have a number of cutting elements 223 and/or wear pads 225 secured to an exterior thereof. The cutting elements 223 may be exposed on leading edges of the plate 222, to engage and degrade an inner wall of a borehole, while the wear pads 225 may be positioned on protruding surfaces of the plate 222, to resist wear from the inner wall. In some embodiments, the wear pads 225 may be configured to function as a pivot point for the drill bit 210 when one or more of the pistons 224 are controlled to steer the drill bit 210 and drilling tool 220. The wear pads 225 may have a number of wear-resistant elements, such as tungsten carbide inserts, diamond inserts, or PCD inserts.

This plate 222 may further include one or more dynamic elements, such as a piston 224, radially extendable therefrom. In certain embodiments, such as the one shown, this dynamic element may have a number of cutting elements 226 exposed thereon. The cutting elements 226 may include, but are not limited to one or more planar or non-planar cutting elements having an ultrahard material. The exact layout of the plate 222 may be selected for its ability to enhance drilling performance. In some embodiments, the wear pads and/or the piston of the plate may include the piston and extendable cutting elements as described in U.S. patent application Ser. No. 16/216,966, which is incorporated by reference herein in its entirety for all purposes. Specifically, the number, positioning, design and types of cutting elements, wear pads, and/or dynamic elements, or the general size of the plate, could be chosen to optimize drilling performance for a particular earthen formation. In some embodiments, such a plate may be formed from wear-resistant matrix material such that the wear pads as shown may be eliminated. The plate 222 may be formed as an integral component by cutting from one or more larger segments, casting, infiltrating, or additively manufacturing. Further, while the present embodiment shows plates formed as a single uniform part, modularly constructed plates may also be used and perform similarly.

In some embodiments, a nozzle 227 may form part of the elongate body 221 and release pressurized drilling fluid, traveling along the elongate body 221, from an interior of the elongate body 221 to an exterior thereof. This nozzle 227 may be directed toward the plate 222 to clean aggregate material, collected from the borehole inner wall from the exposed cutting elements 223.

The drill bit 210 has a bit radius defined by a gauge cutting element of the drill bit 210. The active cutting element 233 that interfaces with the formation immediately prior to the cutting elements 226 of the piston 224 affects the DLS of the drilling tool 220 and drill bit 210. It is appreciated that reducing the distance between the cutting element 233 that interfaces with the formation immediately prior to the piston 224 may enable piston extension to decrease without affecting the DLS. Decreasing the distance between the cutting element 233 that interfaces with the formation immediately prior to the piston 224 and maintaining the piston extension may increase the DLS. In some embodiments, the active cutting element 233*a* is on the drill bit 210. In some embodiments, the active cutting element 233*b* is on the drilling tool 220. The drill bit radius about the axis 219 is less than or equal to the radius defined by the active cutting element 233. When the piston 224 is extended, the extension radius of the cutting elements 226 of the piston 224 is greater than the drill bit radius. When the piston 224 is retracted, the retraction radius of the cutting elements 226 of the piston 224 is less than or equal to the drill bit radius. One or more gauge cutting elements 229 of the drilling tool 220 axially above the piston 224 define a final gauge radius that is greater than the extension radius about the axis 219. In some embodiments, the drill bit radius is between 85 to 95 percent, 88 to 93 percent, or 90 percent of the final gauge radius. In some embodiments, the extension radius may be greater than 98 percent of the final gauge radius. In some embodiments, a distance between the piston 224 and the cutting element 233*a* of the drill bit 210 at the bit radius is between 1.0 to 2.5 times the bit radius. For example, the piston 244 may be axially spaced between 4.5 to 8.0 inches from the gauge cutting element of the drill bit 210 having a 3.95 inch radius. In some embodiments, the active cutting element 233*b* of the drilling tool 220 between the piston 244 and the drill bit 210 is between 25 to 65 percent of the bit radius. For example, the active cutting element 233*b* may be axially spaced between 1.0 to 2.5 inches from the gauge cutting element 229 of the drill bit having a 3.95 inch radius. The wear pad 225 may be axially spaced from the gauge cutting element of the drill bit 210 by a distance between 1.5 to 3.0 times the bit radius. For example, the gauge cutting element 229 may be axially spaced between 7.0 to 9.0 inches from the gauge cutting element of the drill bit having a 3.95 inch radius.

Figure 3:
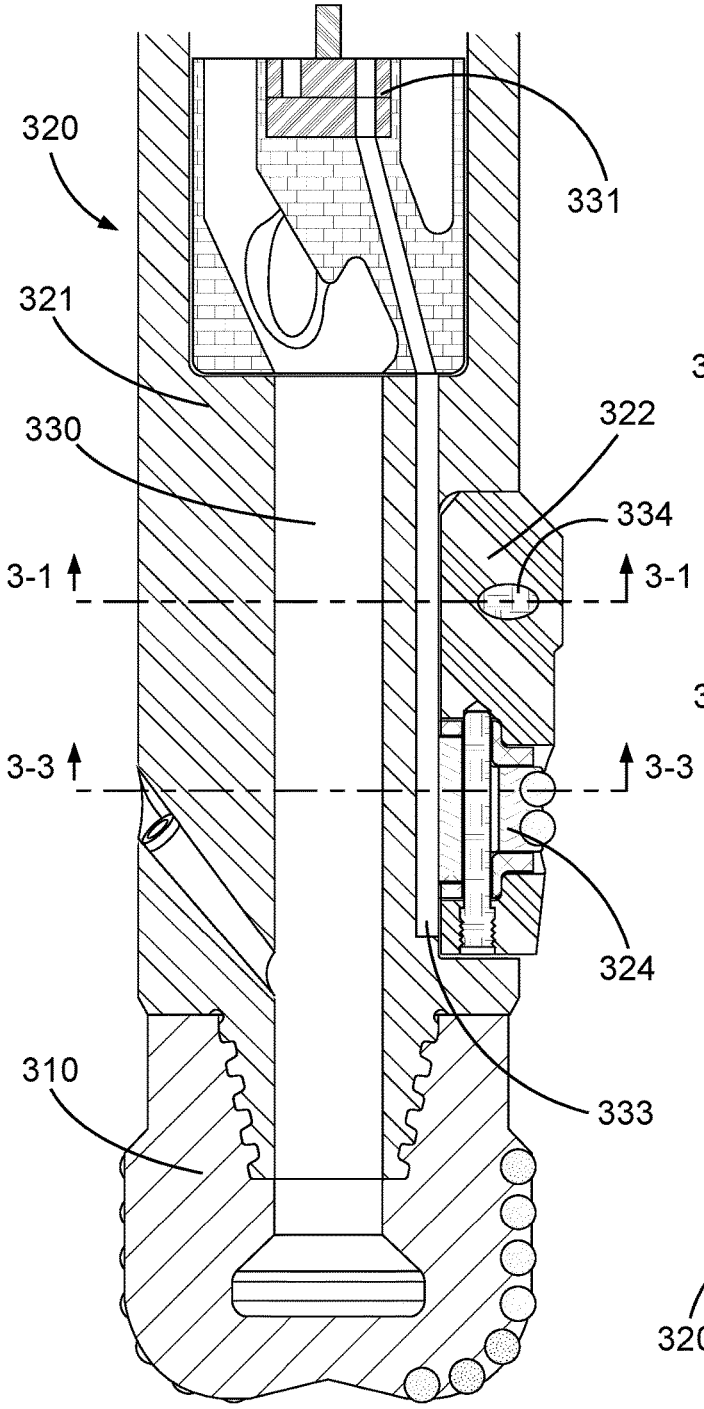
Figures 1, 3:
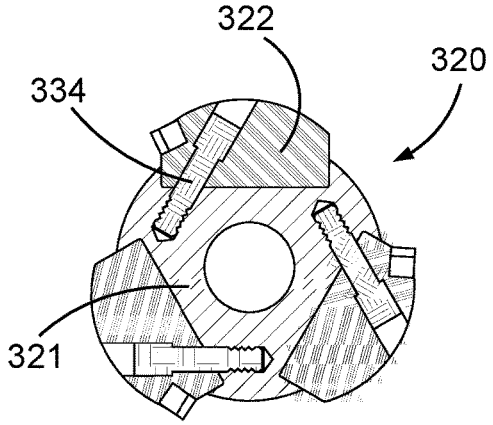
Figures 2, 3:
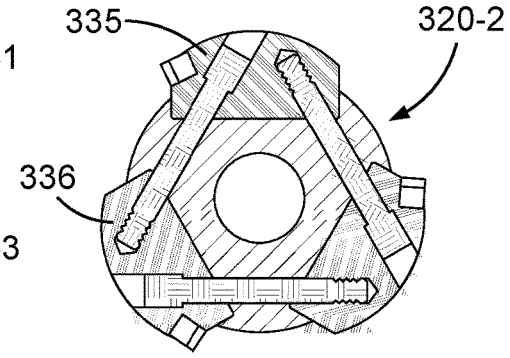
Figure 3:
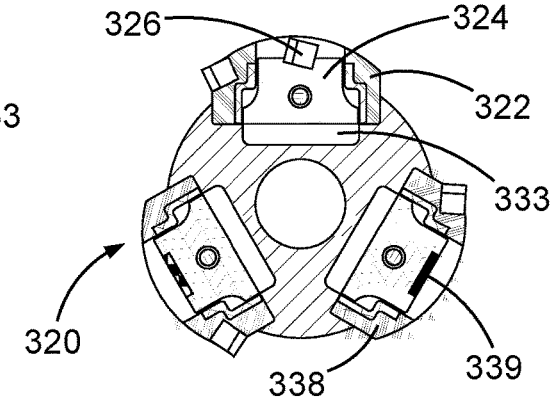

FIG. 3 shows another embodiment of a drilling tool 320 including a plate 322 secured to an exterior of an elongate body 321. This elongate body 321 may have a fluid channel 330 passing axially therethrough. The fluid channel 330 may allow pressurized drilling fluid to be conveyed through the elongate body 321 to a drill bit 310 secured to or downhole of one end of the elongate body 321. A valve 331, housed within the elongate body 321, may channel a portion of this pressurized drilling fluid to a cavity 333 formed at an intersection between the plate 322 and the elongate body 321. This portion of pressurized drilling fluid may urge a piston 324, forming part of the plate 322, to extend radially therefrom.

FIG. 3-1 shows another view of the drilling tool 320 depicted in FIG. 3. As can be seen in FIG. 3-1, the plate 322 discussed previously may be one of a plurality of plates spaced circumferentially from each other about the elongate body 321. Each of these plates may, like the first plate 322, be secured to the elongate body 321 by one or more bolts 334 passing through the plate 322 and threading into the exterior of the elongate body 321.

FIG. 3-2 shows an alternate embodiment of a drilling tool 320-2 wherein a first plate 335 is bolted to a second plate 336, through a hole in an elongate body, such that both are secured to an exterior of the elongate body.

FIG. 3-3 shows yet another view of the drilling tool 320 depicted in FIG. 3. In this view the piston 324 can be seen forming part of the plate 322. The cavity 333, formed by the intersection of the plate 322 and elongate body 321, is also visible. In some embodiments, such as this one, the piston 324 may further include at least one cutting element 326, exposed on an end thereof, capable of engaging and degrading an inner wall of a borehole. Another plate 338, spaced circumferentially about the elongate body 321 from the other, may include a piston with a sensor 339 housed therein capable of pressing against an inner wall of the borehole to obtain a more accurate measurement. Such a sensor may measure, for example, internal variables (e.g. temperature, shock, 6-axis acceleration, pressure, strain) or external variables (e.g. electromagnetic waves, gamma rays, fluid spectroscopy, optical density, fluid fluorescence, H2S).

Figure 4:
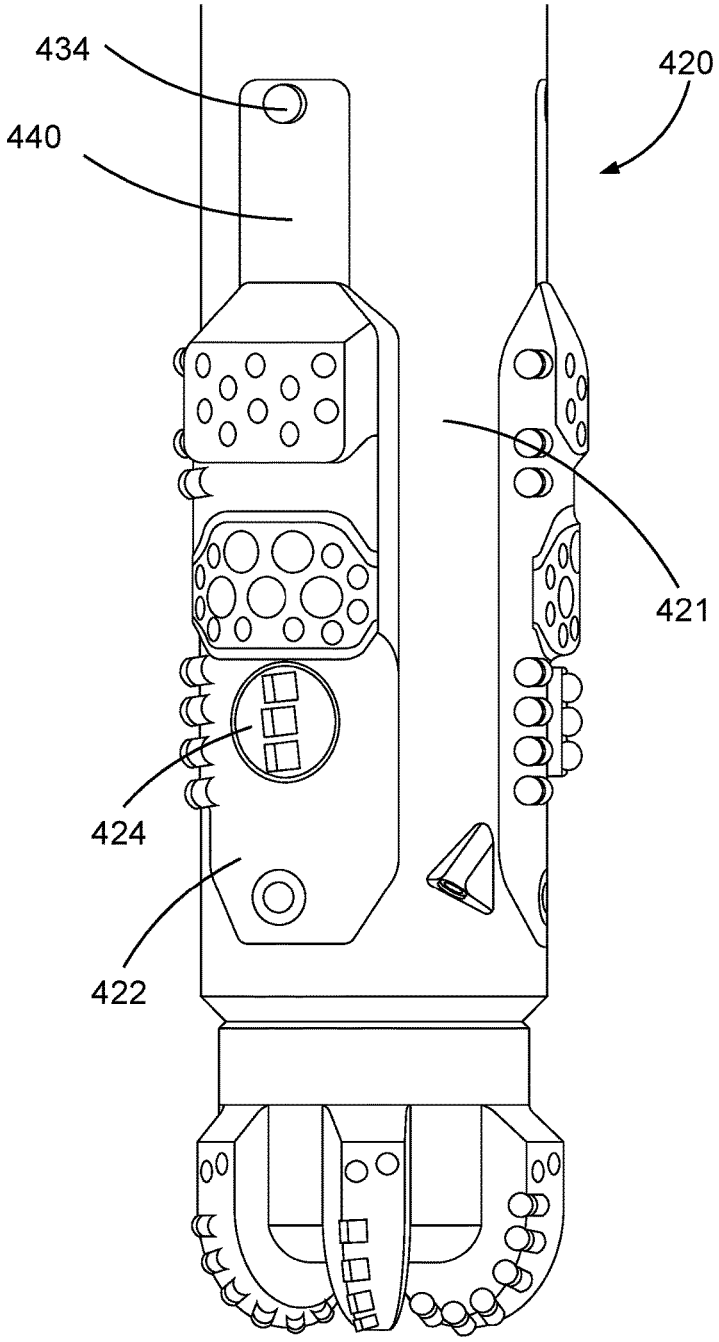
FIG. 4 is an orthogonal view of an embodiment of drilling tool including an elongate body with a plate and a valve secured to an exterior of the elongate body.
Figures 1, 4:
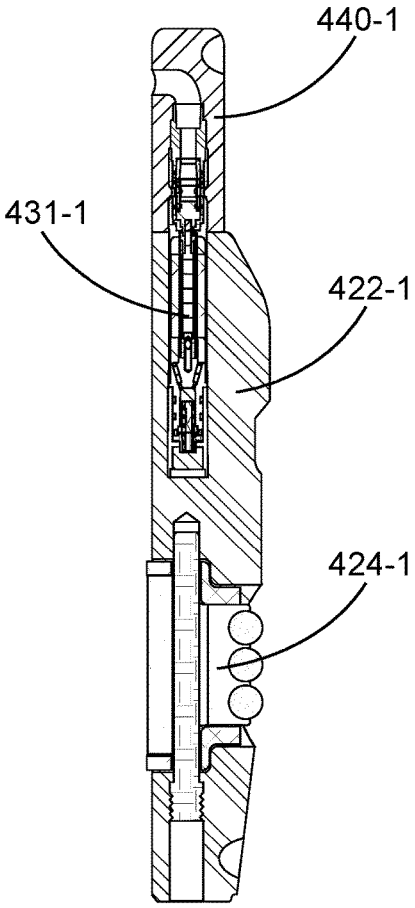

FIG. 4 shows an embodiment of a drilling tool 420 including at least one plate 422 secured to an exterior of an elongate body 421. A dynamic element, in the form of a piston 424, may be radially extendable from the plate 422 when pressurized by drilling fluid traveling through the elongate body 421. While the present embodiment shows a piston 424 having a generally cylindrical shape, a variety of other cross-sectional shapes (e.g. oval) may also be used. A valve may channel a portion of this drilling fluid to the dynamic element to extend the piston 424. This valve may be held within a valve housing 440 secured to the exterior of the elongate body 421. The valve housing 440 may be secured to the elongate body 421 by one or more bolts 434. Both the plate 422 and valve housing 440 may be easily removable from the elongate body 421 for rapid replacement. In some embodiments, the plate 422 and the valve housing 440 interlock, mate with one another, or are radially stacked together with the elongate body 421 to facilitate securing the components to the elongate body 421.

FIG. 4-1 shows embodiments of a valve housing 440-1 and a plate 422-1. The valve housing 440-1 may hold a valve 431-1 capable of channeling drilling fluid to a piston 424-1 forming part of the plate 422-1. In certain embodiments, such as the one shown, a section of the valve 431-1 may be engaged within the plate 422-1 such that the two may be replaced together.

Figure 5:
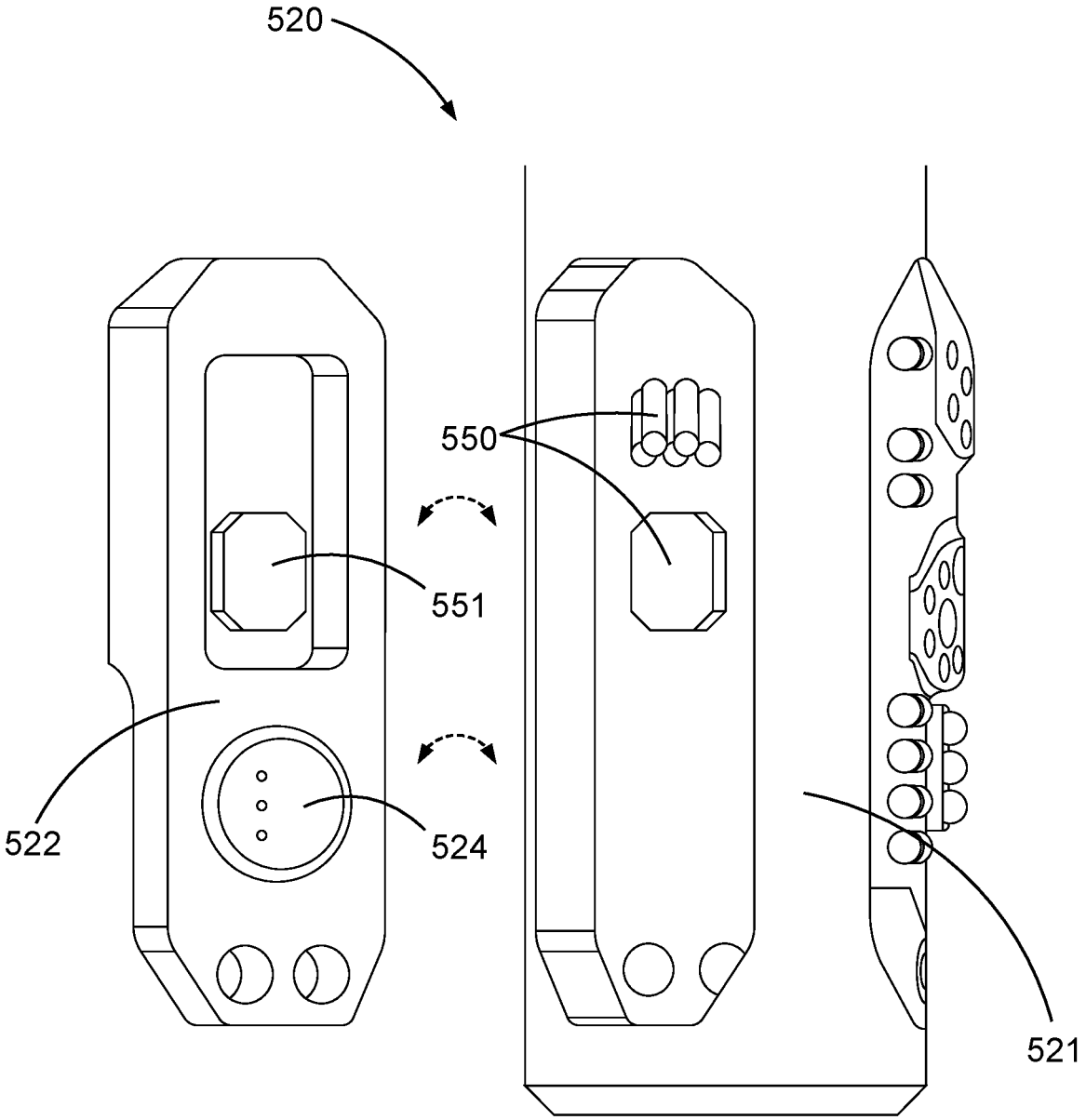
FIG. 5 is an orthogonal view of a plate, including electronics attached to a base thereof, and an elongate body, including electronics attached to an exterior thereof.

FIG. 5 shows another embodiment of a drilling tool 520 with a plate 522 temporarily separated from an elongate body 521. With the plate 522 removed from the elongate body 521 it is possible to see a variety of electronics 550 that may be attached to an exterior of the elongate body 521. Similar electronics 551 may also be attached to a base of the plate 522. While in the embodiment shown these electronics 550, 551 are exposed when the plate 522 is removed from the elongate body 521, in alternate embodiments similar electronics may be embedded in their respective plate and body or disposed in covered compartments. In various embodiments such electronics may include any of a variety of components such as one or more processors, data storage, sensors, circuit boards, power storage (e.g., batteries), wired or wireless communication interfaces, and/or inductive couplers. Both sets of electronics 550, 551 may be covered and protected by the plate 522 when it is secured to the elongate body 521. In some embodiments, one or more seals are configured to isolate the electronics from the downhole environment during operation. These electronics 550, 551 may also be positioned relative to each other, when the plate 522 is attached to the elongate body 521, such that they may allow for wireless communication, including data and/or power, between the plate 522 and the elongate body 521, by inductive coupling for example.

With the plate 522 removed it is also possible to see an underside of a piston 524, forming part of the plate 522 and radially extendable therefrom. This piston 524 may open to the base of the plate 522 such that it is exposed to a cavity formed between the plate 522 and the elongate body 521. In such an arrangement, pressurized drilling fluid enclosed within this cavity formed between the plate 522 and the elongate body 521 may urge the piston 524 to extend radially from the plate 522.

Figure 6:
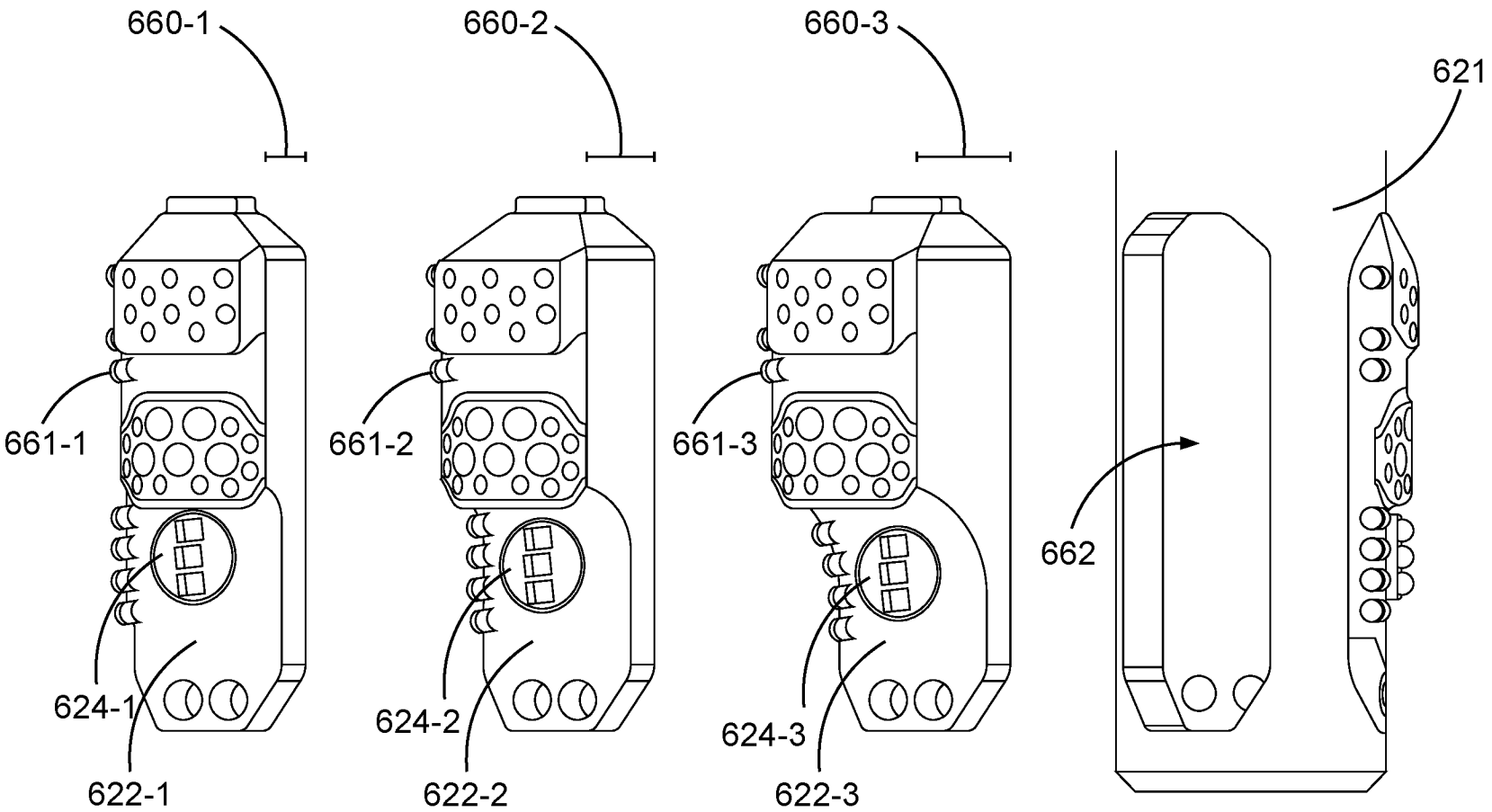
FIG. 6 is an orthogonal view of embodiments of differently-sized plates, each of which could be secured to a single elongate body at different times.

FIG. 6 shows an embodiment of an elongate body 621 including an opening 662 in a side thereof. A variety of distinctive plates 622-1, 622-2, 622-3 may, at different times, be inserted into this single opening 662 and secured therein. Each of these individual plates 622-1, 622-2, 622-3 may include unique features that it may impart to a drilling tool. In various embodiments, such unique features may be produced through a process including additive manufacturing. For example, each of the individual plates 622-1, 622-2, 622-3 may have a unique radial width 660-1, 660-2, 660-3. In some embodiments, the travel of the piston 624-1, 624-2, and 624-3 may be the same, but the positioning within the respective plate is configured to facilitate the unique radial width 660-1, 660-2, 660-3. In some embodiments, the travel of the pistons 624-1, 624-2, 624-3 varies for each respective plate. For example, the travel of the piston 624-1 of the plate 622-1 may be less than the travel of the piston 624-3 of the plate 622-3.

Because of this, a drilling tool formed by any of these individual plates 622-1, 622-2, 622-3 may have a unique maximum radial dimension. More specifically, a drilling tool formed by securing a second plate 622-2 to the elongate body 621 may have a larger maximum radial dimension than a drilling tool formed by securing a first plate 622-1 to the same elongate body 621. Further, a drilling tool formed by securing a third plate 622-3 to the elongate body 621 may have a maximum radial dimension even larger still. Each of the individual plates 622-1, 622-2, 622-3 may also include at least one cutting element 661-1, 661-2, 661-3 exposed on a leading edge thereof at its respective unique maximum radial dimension. Such cutting elements 661-1, 661-2, 661-3 may allow drilling tools formed by each respective individual plate 622-1, 622-2, 622-3 to open a borehole to a unique size. Accordingly, the elongate body 621 of a certain radial dimension may be configured with sets of plates 622 to facilitate a range of maximum radial dimensions for a range of borehole sizes.

Figures 1, 7:
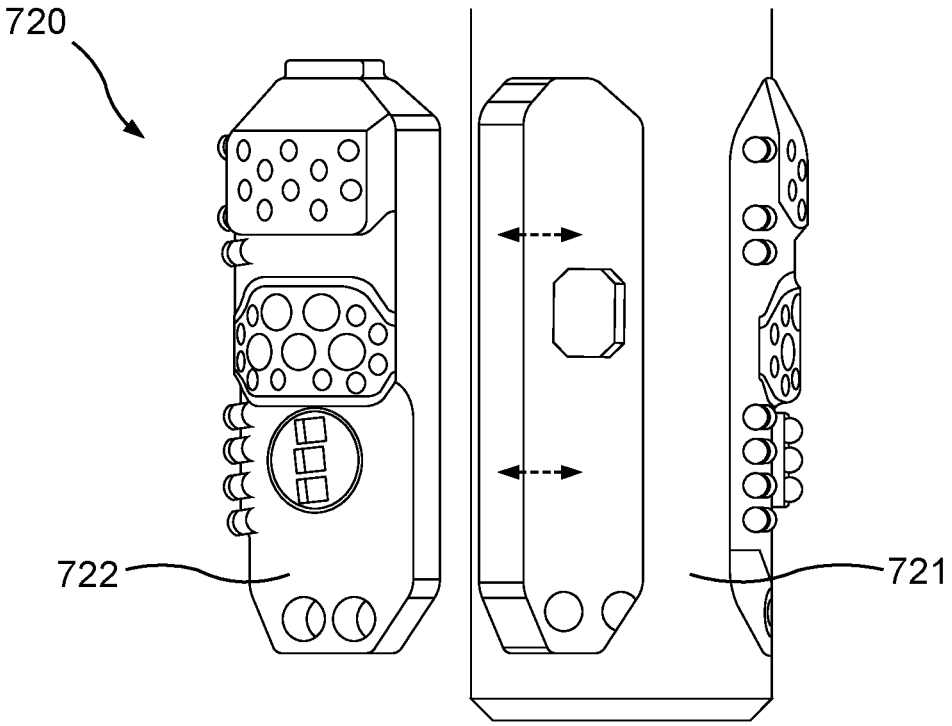
Figures 2, 7:
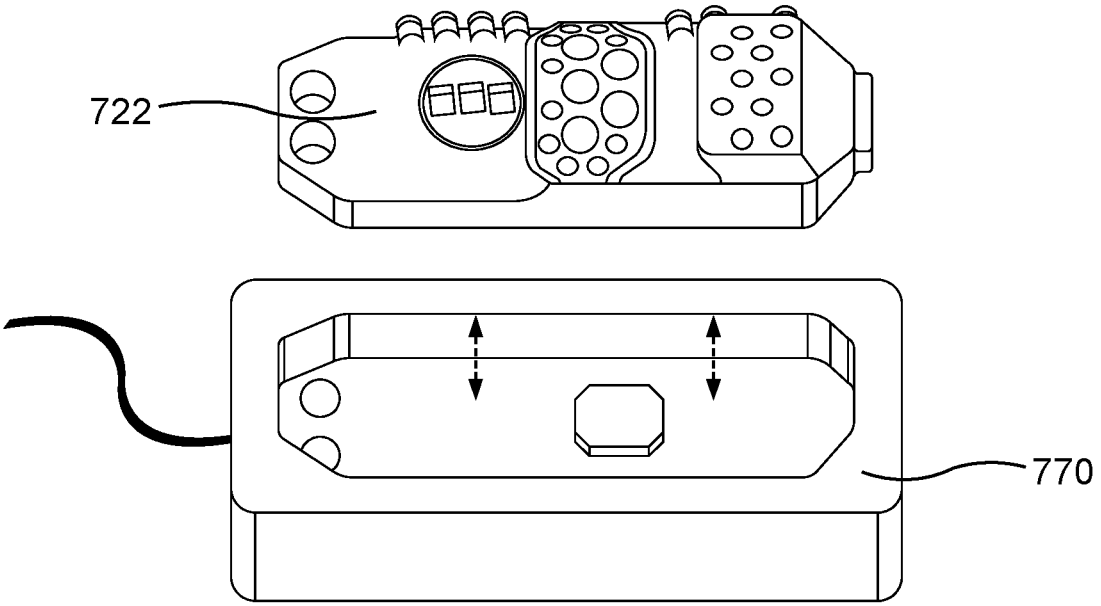

FIG. 7-1 shows an embodiment of a drilling tool 720 including a plate 722 detached from an elongate body 721. The plate 722 may be detached from the elongate body 721 and attached to a docking station 770, as shown in FIG. 7-2. While attached to the elongate body 721, the plate 722 may be capable of communication with the elongate body 721. Similarly, while attached to the docking station 770, the plate 722 may be capable of communication with the docking station 770. Such an arrangement may allow for a variety of features. For example, electronics of the plate 722 may include a processor capable of aggregating and interpreting data resident on the plate 722 or in combination with other data received from the docking station 770 (from cloud storage for example). The docking station 770 may be able to translate raw or semi-processed data from the plate 722 and send it on to other distributed computing systems for further computation and/or storage. The processor of the plate 722 may be diagnostically tested to ensure its proper functioning via wireless communication with the docking station 770. As another example, the electronics of the plate 722 may include data storage. Via wired or wireless communication with the docking station 770, this data storage may be reprogrammed to interact differently with the elongate body 721 when the plate 722 is returned. In yet another example, the electronics of the plate 722 may include a battery. Via wireless communication with the docking station 770, this battery may be recharged. After communications of data and/or power between the plate 722 and the docking station 770 is complete, the plate 722 may be installed with the same or different drilling tool 720. Moreover, one or more cutting elements or worn components of the plate 722 may be repaired or replaced prior to reinstallation on a drilling tool 720.

Extendable Elements from Drilling Tool with Mud Motor

A downhole tool, forming part of a subterranean drilling system, may include a motor including a rotor rotatable with respect to a stator. When drilling with such a motor, directional steering may be accomplished by first holding the stator rotationally stationary in a certain rotational orientation. While the stator is held, this rotational orientation may be detected by a sensor housed within the rotor. The detected rotational orientation may be saved within data storage housed within the rotor or maintained by a gyroscope-accelerometer combination.

Next, the stator may be rotated about a longitudinal axis thereof. While the stator is rotating, a dynamic element may be extended and retracted radially from a side of the rotor. Extension of this dynamic element may help steer the tool by pushing against an inner wall of a borehole or removing material from the inner wall in certain radial directions. These extensions may be controlled and synchronized by a processor to occur when the dynamic element is at desired circumferential positions to steer the tool in a direction corresponding to the rotational orientation sensed previously. In some embodiments, the processor is housed within the downhole tool.

Holding the stator rotationally stationary at certain times and rotating it at others may be accomplished by attaching the stator to a distal (e.g., downhole) end of a drill string and controlling rotational orientation of the drill string at a proximal (e.g., uphole) end thereof. Rotational alignment of the proximal end should typically orient the distal end, especially when the drill string is lifted off a terminus of the borehole. In this manner, a desirable steering direction may be communicated downhole to the stator from above the surface of the borehole via the drill string. Extension of the dynamic element may then be controlled and synchronized to achieve this steering direction once the stator is again rotated.

In some embodiments, additional information regarding desirable steering parameters may be communicated along the drill string by other means. For example, a duration of time that the stator is held stationary or that drilling fluid is transported through the drill string may be detected from the downhole tool and indicate an arc length which that dynamic element should be extended.

The rotor may include at least one cutting surface fixed to an exterior thereof and capable of engaging an inner wall of a surrounding borehole as the rotor rotates. To help the downhole tool ride against this borehole inner wall, the stator may include at least one protrusion radially projecting therefrom axially proximate to this fixed cutting surface of the rotor.

Figure 8:
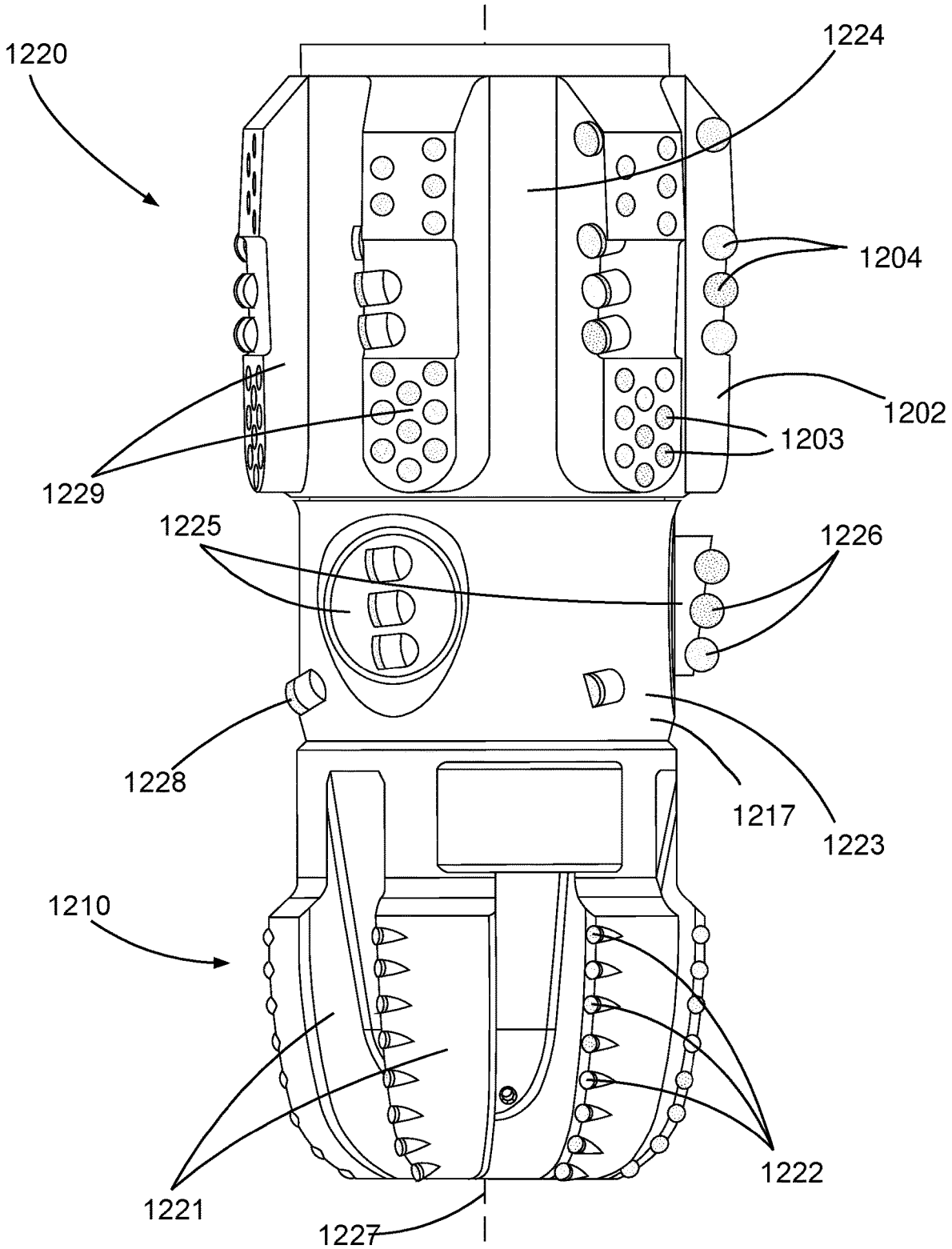
FIG. 8 is an orthogonal view of an embodiment of a downhole tool that could form part of a subterranean drilling operation.

FIG. 8 shows an embodiment of a downhole tool 1220 or drilling tool that could form part of a subterranean drilling operation as just described. The downhole tool 1220 may be disposed adjacent to or proximate a drill bit 1210 at a distal end of a drill string (not shown) as shown or at other positions along such a drill string. The drill bit 1210 shown includes a plurality of blades 1221 radially and axially protruding from a working end thereof and a plurality of cutting surfaces 1222 fixed to leading edges of each of the blades 1221; however, a variety of other types of drill bits, such as roller cone or impregnated bits, may also be used with the downhole tool 1220.

The downhole tool 1220 may include a rotor 1223 rotatable relative to a stator 1224. The rotor 1223 may be rotated by pressurized drilling fluid traveling along the drill string from the surface or by other means known in the art. The rotation of the rotor 1223 relative to the stator 1224 increases the rotation about the longitudinal axis 1227 of the rotor 1223 and the components of the drill string connected thereto. The rotor 1223 may include at least one dynamic element 1225 radially extendable and retractable from an exterior of the rotor 1223. In the embodiment shown, this radially-extendable element 1225 includes at least one cutting surface 1226 fixed to an exterior thereof and capable of removing material from a borehole inner wall when the dynamic element 1225 is extended. In alternate embodiments, however, radially-extendable elements may include smooth exterior surfaces capable of pushing against a borehole inner wall without removing material therefrom. In such an arrangement, a drill bit may include a larger cross-sectional diameter than an associated stator. In other embodiments, a single tool may include at least one dynamic element including cutting surfaces exposed thereon and at least one including a smooth exterior surface. Such a tool may be capable of removing material at certain times and pushing against an inner wall at others. Additionally, or in the alternative, one or more dynamic elements of the downhole tool 1220 may include a marking element, a sensor, or any combination thereof, as described in the U.S. patent application Ser. No. 16/898,491 filed Mar. 24, 2020, which is incorporated by reference herein in its entirety for all purposes.

Extension and retraction of this dynamic element 1225 may be performed while the stator 1224 is rotated about a longitudinal axis 1227 thereof. In some embodiments, a dynamic element of the stator 1224 may be actuated to aid steering of the downhole tool while the stator 1224 rotates about the longitudinal axis 1227. It is believed that in some situations rotating this stator 1224 while drilling, rather than merely sliding it axially through a borehole, may decrease its chances of getting stuck in the borehole. The rotor 1223 may include at least one cutting surface 1228 fixed to an exterior thereof. This cutting surface 1228 may remove material from an inner wall of the borehole and reduce the likelihood of this inner wall rubbing against the rotor 1223. The cutting surface 1228 may radially extend further from the longitudinal axis 1227 than the cutters of the drill bit 1210.

In some embodiments the cutting surface 1228 of the rotor 1223 radially extends further from the longitudinal axis 1227 than the at least one cutting surface 1226 of the dynamic element 1225 when the dynamic element is retracted, thereby reducing or eliminating wear on the at least one cutting surface 1226 of the dynamic element 1225. In some embodiments, the at least one cutting surface 1228 of the rotor 1223 is axially disposed between the one or more dynamic elements 1225 and a distal end 1217 of the downhole tool 1220. In some embodiments, the at least one cutting surface 1228 is disposed on the rotor 1223 in an axially overlapping position with the one or more dynamic elements 1225. In some embodiments, the at least one cutting surface 1228 of the rotor 1223 is axially disposed between the on the one or more dynamic elements 1225 and the stator 1224.

The stator 1224 may include at least one protrusion 1229 (e.g., blade) radially projecting from an exterior of the stator 1224. A wear surface 1202 of the at least one protrusion 1229 radially extends from the longitudinal axis 1227 further than the at least one cutting surface 1226 of the dynamic element 1225 when the dynamic element 1225 is retracted. In some embodiments, the cutting surfaces 1226 of the dynamic element 1225 protrude radially from the longitudinal axis 1227 further than the wear surface 1202 when the dynamic element 1225 is extended from the rotor 1223. The one or more wear surface 1202 are configured to ride against an inner wall of a surrounding borehole uncut by the one or more cutting surfaces 1226 of the dynamic element 1225 when steering the downhole tool 1220. In some embodiments, a wear resistant coating (e.g., hardfacing) may be applied to portions of the wear surface 1202 of the at least one protrusion 1229. In some embodiments, one or more wear pads 1203 (e.g., inserts, wear resistant elements) may be inserted and/or fixed to exposed portions of the wear surface 1202. Trimming surfaces 1204 (e.g., cutters) near a proximal end of the at least one protrusion 1229 may enlarge the borehole to a desired diameter about the longitudinal axis 1227.

In some embodiments, the downhole tool 1220 having the stator 1224 and the rotor 1223 with the at least one dynamic element 1225 is coupled to the drill bit 210 such that one or more components of the downhole tool 1220 are within a desired distance from the drill bit 1210. In some embodiments, the wear surface 1202 of the at least one protrusion 1229 may be axially offset a distance from the outermost cutter of the drill bit 1210 that is between 0.25 to 5 times, 0.5 to 3 times, or 0.5 to 1.5 times the diameter of the drill bit 1210. In some embodiments, the downhole tool 220 is configured such that the wear surface 1202 of the at least one protrusion 1229 is axially offset a distance from the outermost cutter of the drill bit 1210 between 0.25 to 7 times, 0.3 to 5 times, or 0.75 to 2 times the diameter of the drill bit 1210. Furthermore, in some embodiments, the distance of one or more components (e.g., wear surface 1202) of the stator 1224 from the drill bit 1210 may affect the diameter of the drill bit 1210. That is, the distance between the wear surface 1202 of the rotor 1224 and the drill bit 1210 may inversely related to the diameter of the drill bit if a desired build angle or dogleg severity (DLS) is to be achieved by the downhole tool 1220.

Figure 9:
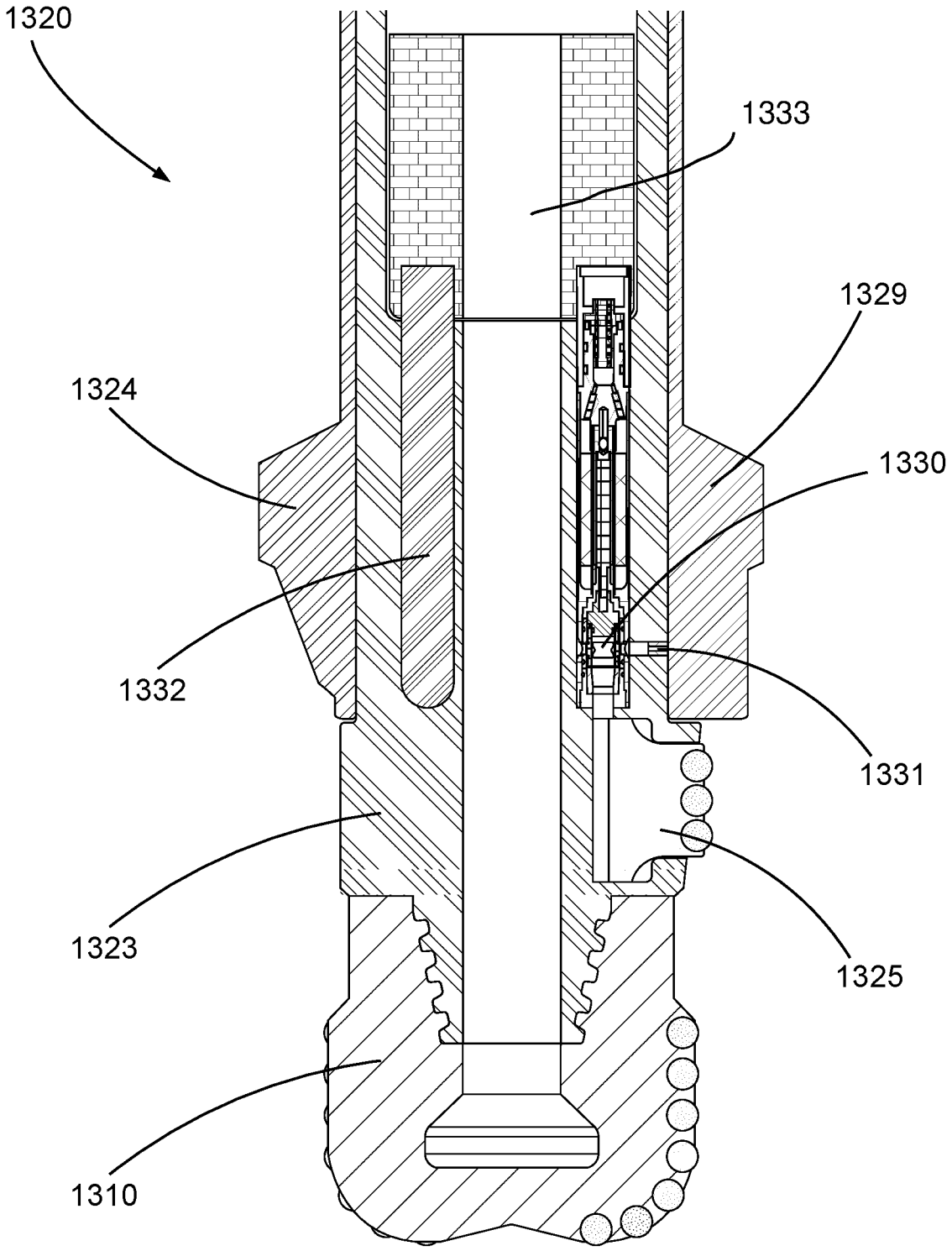
FIG. 9 is a longitude-sectional view of another embodiment of a downhole tool that could form part of a subterranean drilling operation.

FIG. 9 shows another embodiment of a downhole tool 1320 that could form part of a subterranean drilling operation. This downhole tool 1320 may also include a rotor 1323 rotatable relative to a stator 1324. In this embodiment, an axial section of the rotor 1323 may be radially encompassed by the stator 1324. Such an arrangement may allow protrusions 1329, radially projecting from an exterior of the stator 1324, to be positioned in relatively close proximity axially to a drill bit 1310 disposed on a distal end of a drill string. Such an arrangement may also allow for various components to be housed within the rotor 1323 without substantially lengthening the downhole tool 1320. For example, in various embodiments, at least one of a processor, data storage, a battery, a capacitor, a turbine and a valve may be housed within the encompassed section of the rotor 1323.

In this particular embodiment, the rotor 1323 includes at least one valve 1330 within this encompassed section. This valve 1330 may be capable of channeling of portion of pressurized drilling fluid, traveling along a drill string a fluid channel 1333 from the surface of the earth, to a dynamic element 1325 to extend the element 1325 radially from a side of the rotor 1323. In some embodiments, the rotor 1323 includes at least one nozzle 1331, passing from an interior of the rotor 1323 to an interior of the stator 1324, to lubricate surfaces between the rotor 1323 and stator 1324. The valve 1330, mentioned earlier, may alternate between channeling drilling fluid to the radially-extendable element 1325 and this nozzle 1331.

In some embodiments, the rotor 1323 includes at least one sensor 1332 capable of detecting a rotational orientation of the stator 1324 while the stator 1324 is held rotationally stationary. Various types of sensors may able to achieve this task. For example, certain types of sensors, such as magnetometers, accelerometers, gyroscopes and micro-electromechanical systems, may be able to measure a rotational orientation of a stator relative to the earth. Other types of sensors may be able to detect a position indicator forming part of a stator to measure a rotational orientation of the stator relative to a rotor. Such indicator-sensor pairings may include, but are not limited to, a magnet and a magnetometer, a metal void and a magnetometer-magnet combination, a sealable nozzle and a pressure sensor, or a hole and a hydrophone. In some embodiments, an additional measurement-while-drilling system, disposed at some point along the drill string, may confirm stator orientation detected by the sensor 1332. Although the sensor 1332 is shown within the rotor 1323 in FIG. 9, some embodiments of the downhole tool 1320 may have a sensor within the stator 1324 alone or in combination with the sensor 1332 in the stator 1324. As discussed above with the sensor 1332 within the rotor 1323, a sensor within the stator 1324 may be able to measure a rotational orientation of the stator 1324 relative to the earth and/or a rotational orientation of the rotor 1323 relative to the stator 1324.

In some embodiments, the rotational orientation detected by the sensor 1332 may be stored digitally within data storage housed within the rotor 1323, such as with the sensor 1332. In some embodiments, the rotational orientation detected by the sensor 1332 may be maintained by a gyroscope-accelerometer combination. Once the stator 1324 begins to rotate again, a processor, powered by a battery, a capacitor or a turbine, may use this stored rotational orientation to synchronize activation of the valve 1330 such that fluid is channeled to the dynamic element 1325 and the dynamic element 1325 extends based on the rotational orientation previously detected. One or more of the processor, the capacitor or turbine, or other power source may be housed within the rotor 1323 or a nearby component of the drill string. While the various components just described are shown embedded in the rotor 1323 in the present embodiment, alternate embodiments may include similar components housed within a replaceable cartridge.

Figures 2, 10:
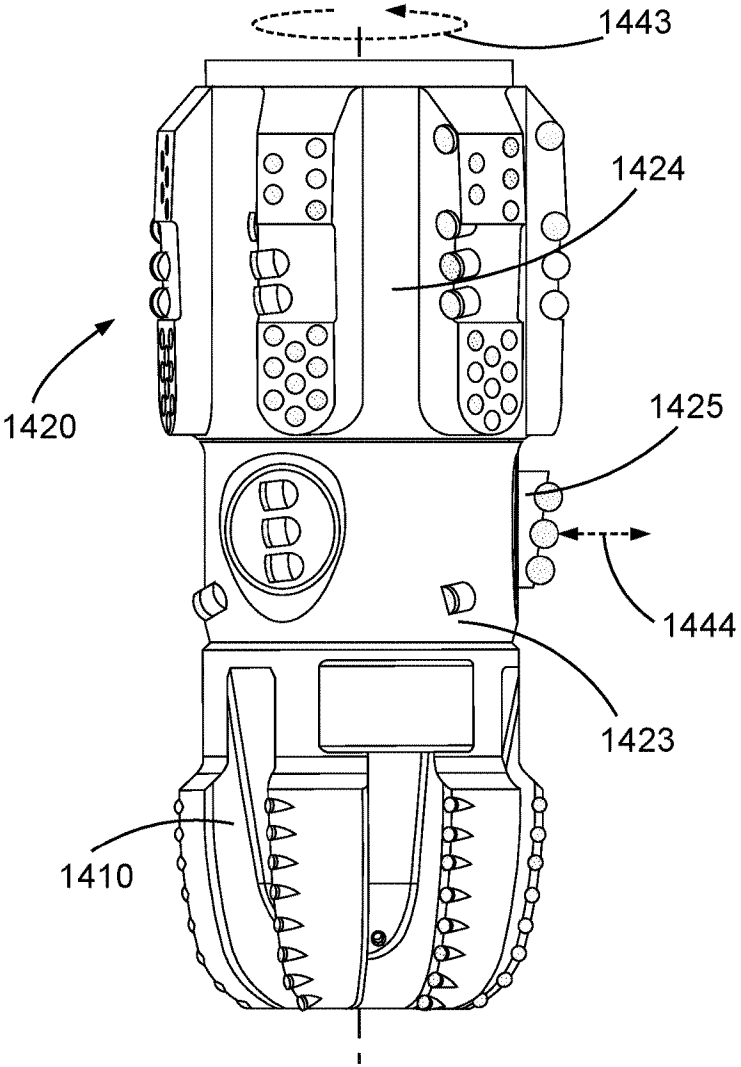
Figures 1, 10:
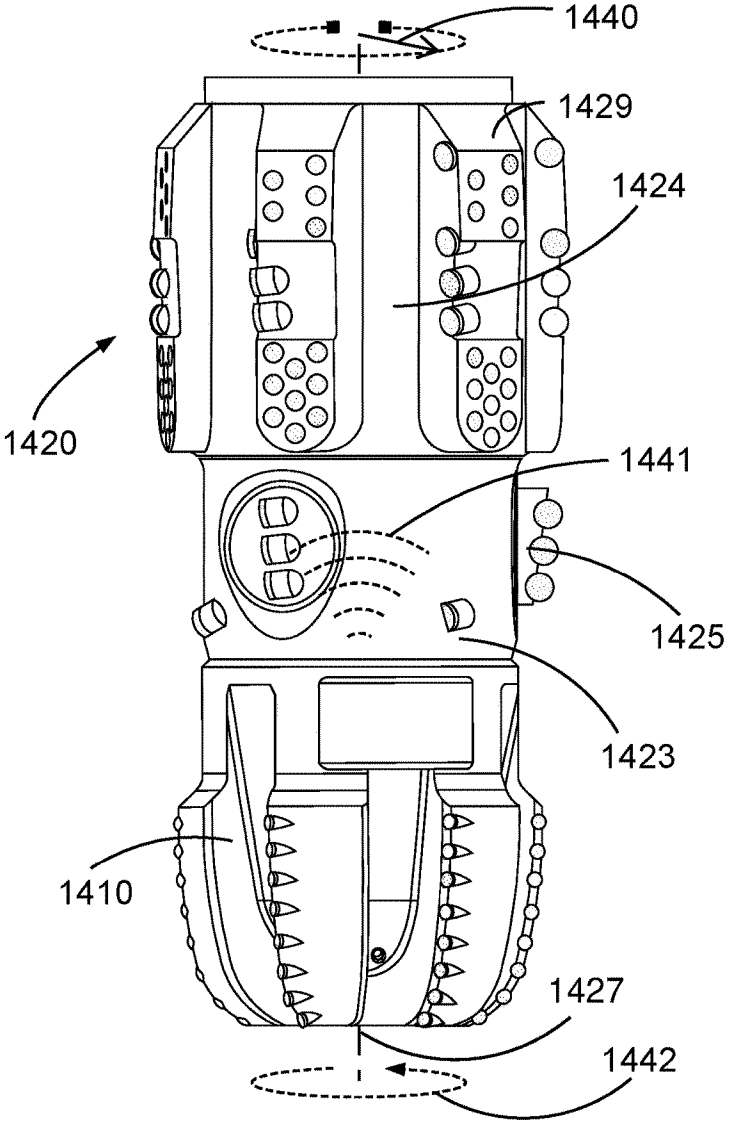

FIGS. 10-1 and 10-2 show another embodiment of a downhole tool 1420 (e.g., motor) including a rotor 1423 rotatable with respect to a stator 1424. This downhole tool 1420 may be suspended from a derrick by a drill string as described in relation to FIG. 1. The drill string itself may be rotated via torque applied at the derrick. This torque may pass down through the drill string to the stator 1424 of the downhole tool 1420, to which the drill string is rigidly attached. The drilling fluid directed through the downhole tool 1420 may rotate the rotor 1423 relative to the stator and add to this torque on the drill string such that a drill bit 1410, attached rigidly to the rotor 423, rotates at a higher velocity than the stator 1424 of the downhole tool 1420.

To steer the drill bit 1410, as it forms a borehole in the earth, rotation of the drill string at the derrick may first be temporarily halted. This is typically done at regular intervals anyway to allow for additional pipe sections to be added to the drill string so it should not slow the drilling operation significantly. While rotation of the drill string is halted, the drill string may be axially lifted from the derrick to relieve pressure on the drill string. This may allow a rotational orientation at the stator 1424 to better correspond with a rotational orientation of the drill string at the derrick. In some embodiments, wired or wireless communication between sensors of the downhole tool 1420 and the components of the drill string or the surface may be used while rotation of the drill string is halted.

While lifted, the drill string at the surface and/or derrick may be rotated to a desired azimuth to orient the stator 1424 in a particular orientation. For example, a sensor of the stator 1424 proximate a first protrusion 1429 may be oriented about the longitudinal axis 1427 toward a first position 1440, as shown in FIG. 10-1. In effect, the drill string itself is being used to communicate a rotational orientation downhole. In some embodiments, downhole survey data 1441 relating to the actual measured rotational orientation of the stator 1424 may be sent up hole to aid in this effort. This communicated rotational orientation may represent a signal capable of interpretation by downhole instrumentation. A sensor, housed within the rotor 1423, may detect the lack of rotation of the stator 1424, or the axial lifting, and measure a rotational orientation of the stator 1424. This measured rotational orientation may be stored within the downhole tool 420 or transmitted 1441 up hole to a component of the drill string or to the surface. In some embodiments, the measured rotational orientation of the stator 1424 is saved within data storage housed within the rotor 1423. In some embodiments, the measured rotational orientation of the stator 1424 is maintained by a gyroscope-accelerometer combination in others. In some embodiments, a time duration that the stator 1424 is held stationary may also be measured from the rotor 1423 and stored.

While lifted, drilling fluid may be passed through the drill string from the derrick to the drill bit 1410. In some embodiments, this drilling fluid may act to rotate 1442 the rotor 1423 with respect to the stator 1424 of the downhole tool 1420. A sensor, housed within the rotor 1423, may measure an amount of time this drilling fluid is passed through the drill string, information which may also be saved within the data storage. From the time the drilling fluid is passed through the downhole tool 1420 and parameters of the downhole tool 1420, a processor may determine the orientation of the rotor 1423 relative to the stator 1424.

Regulating this fluid flow may be used to communicate useful information downhole. For example, the time spent with fluid flowing but without the stator 1424 rotating may communicate a desired drilling mode. In some embodiments, the desired drilling mode corresponds to an arc length of the extension of the one or more dynamic elements 1425 of the rotor 1423. In some embodiments, the desired drilling mode corresponds to the duty cycle of the time the downhole tool 1420 is in a steering mode with the dynamic element repeatedly extended and retracted while rotating. In one configuration, zero to one-half minutes of non-rotating flow may indicate to maintain a current default drilling mode (such as 25% duty cycle). One-half to one minute of non-rotating flow may indicate to change to 100% duty cycle. One to one-and-a-half minutes of non-rotating flow may indicate to change to 50% duty cycle. And, One-and-a-half to two minutes of non-rotating flow may indicate to change to a neutral mode. It is believed that such a configuration may minimize the amount of time spent flowing unless a change is required.

Once enough information has been communicated downhole to effectuate steering, the drill string may again be rotated at the derrick which may rotate 1443 the stator 1424, as shown in FIG. 10-2. While the stator 1424 is rotating, at least one dynamic element 1425 may be radially extended and retracted from an exterior of the rotor 1423, as shown by arrow 1444. Extension and retraction of this element 1425 may be synchronized with rotation of the rotor 1423 by a processor housed within the downhole tool 1420, based on the rotational orientation stored in the data storage, to steer the drill bit 1410 in a desired direction. In some embodiments, the arc length of this extension may correspond to a time duration that the stator 1424 was held rotationally stationary or that drilling fluid was transported through the drill string.

This process of communicating information downhole via rotational orientation while a drill string is held stationary and then using that information to steer while rotating may be repeated each time a pipe section is added to the string to allow for regular recalibration of a steering operation.

FIGS. 11-1, 11-2 and 11-3 show additional embodiments of downhole tools 1520-1, 1520-2 and 1520-3. In FIG. 11-1, a rotational orientation 1550-1 of a stator from a reference orientation 1549-1 is detected from a rotor while the stator is held rotationally stationary. In FIG. 11-2, an embodiment is shown where a dynamic element 1525-2, including a smooth exterior surface, is extended radially from a rotor, while a stator is rotated, to push against an inner wall of a borehole. The element 1525-2 may be extended in one radial direction 1551-2 and may urge the rotor in an opposing radial direction 1552-2 corresponding to a rotational orientation 1550-1 previously sensed in FIG. 11-1. The dynamic element 1525-2 pushing in direction 1551-2 may cause the downhole tool to enlarge a portion of the borehole in the opposing radial direction 1552-2, thereby steering the downhole tool in the opposing radial direction 1552-2. In FIG. 11-3, an alternate embodiment is shown where a dynamic element 1525-3, including a cutting surface fixed to an exterior thereof, is extended radially from a rotor, while a stator is rotated, to remove material from a surrounding formation in a radial direction 1552-3 corresponding to a rotational orientation previously sensed. It may be appreciated that the radial direction 1552-3 may correspond to a point (e.g., center) within the arc length of the rotation that the dynamic element 1525-3 is extended from the rotor. For example, the dynamic element 1525-3 may be controlled to begin extending from the rotor at position 1554-1 while the downhole tool 1520 rotates about the axis 1527, and the dynamic element 1525-3 may be controlled to a retracted position by the position 1554-2 as the downhole tool 520 rotates. In some embodiments, the arc length between 1554-1 and 1554-2 may be between 120 to 355 degrees, between 180 to 350 degrees, or between 200 to 340 degrees.

Extendable Elements from Drilling Tool and Sleeve

A downhole tool, forming part of a subterranean drilling system, may comprise an elongate body rotatable about an axis passing lengthwise therethrough. A dynamic element may be extendable radially from a side of the elongate body from a position disposed axially between a working end and an opposing attachment end of the body. In certain embodiments, this dynamic element may be extendable by means of pressurized drilling fluid, traveling along the body, urging the element outward. Extension of this dynamic element may, in various embodiments, push the body away from an adjacent borehole inner wall, remove material from the adjacent borehole inner wall via an exposed cutting element, or press a sensor embedded in the dynamic element against the inner wall. In some embodiments, the dynamic element may be replaceable when worn or damaged.

The working end of the elongate body, or a drill bit attached to the working end, may include a variety of cutting elements exposed thereon capable of degrading an earthen formation as the body rotates. One specific cutting element, exposed on the working end or an attached drill bit, may protrude farther from the body's rotational axis than any other cutting element that side of the dynamic element. This specific cutting element may be referred to as a maximum cutting element for later reference.

A hollow sleeve may be slid over the attachment end of the elongate body to radially encompass the body. A drill string, secured to the attachment end, may hold this sleeve in place. In some embodiments, the sleeve may be rotationally held, and even aligned, relative to the elongate body by means of interlocking features, between the sleeve and body.

At least one protrusion may protrude radially from the hollow sleeve, within 3 inches axially from the maximum cutting element. In some embodiments, the at least one protrusion protrudes radially from the hollow sleeve within an axial distance that is less than or equal to the bit radius. At least one additional cutting element may be exposed on the protrusion of the sleeve and possibly on the interlocking feature of the sleeve. If this protrusion becomes worn or damaged, the hollow sleeve may be replaced. More expensive components of the downhole tool may be contained within the elongate body, rather than the hollow sleeve, and thus not require replacement as often.

A hollow-sleeve arrangement may allow for sleeves of differing sizes to be employed at different times without altering the underlying elongate body. Specifically, the sleeve, radially encompassing the elongate body, may be one of a plurality of sleeves each capable of radially encompassing the body. Each of these sleeves may comprise a unique maximum radial dimension such that a single elongate body with one or more dynamic elements may be used in differently sized boreholes by exchanging the sleeve.

While in operation, drilling fluid may be passed through the elongate body and ejected via nozzles disposed on the working end, or on a drill bit attached to the working end. To allow this drilling fluid to flow smoothly back up a borehole, carrying aggregate material therewith, and clean the various elements of the downhole tool, blades protruding radially and axially from the working end (or the drill bit attached to the working end), the dynamic element and the radial protrusion of the sleeve may all be aligned azimuthally around the circumference of the elongate body.

Figure 12:
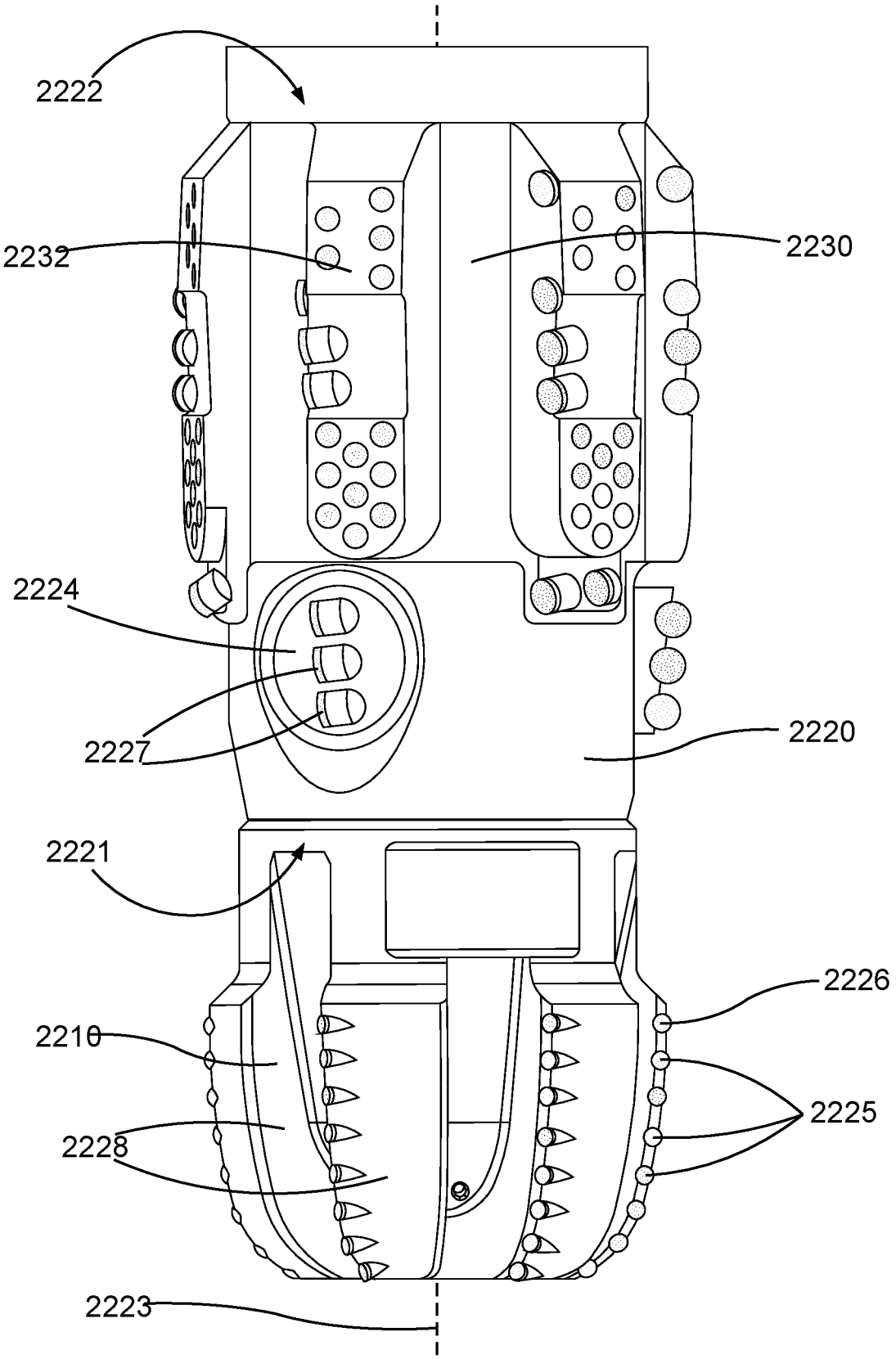
FIG. 12 is an orthogonal view of an embodiment of drilling tool that could form part of a subterranean drilling operation.

Referring now to the figures, FIG. 12 shows an embodiment of a drilling tool that could be incorporated into a drill string of a subterranean drilling operation as just described. This drilling tool may comprise an elongate body 2220 with a working end 2221 disposed on one end of the body 2220 and an attachment end 2222 disposed on an opposite end thereof. The elongate body 2220 may be rotatable about an axis 2223 passing lengthwise therethrough and comprise at least one dynamic element 2224, radially extendable from a side of the body 2220, disposed axially between the working end 2221 and the attachment end 2222. In various embodiments, extension of such a dynamic element may help to steer the drilling tool as it forms a borehole, by pushing against an inner wall of the borehole or degrading the inner wall, or aid in performing a downhole measurement by pressing a sensor against such an inner wall. In the embodiment shown, the dynamic element 2224 includes a plurality of cutting elements 2227, exposed on an exterior thereof, capable of removing earthen material from a borehole inner wall and allowing the drilling tool to steer into that space.

In some embodiments, such as the one shown, a drill bit 2210 may be secured to the working end 2221 of the elongate body. In various embodiments, the working end 2221, and may include assorted cutting elements 2225 exposed thereon capable of degrading tough earthen materials to form a borehole therethrough as the elongate body 2220 is rotated. In the embodiment shown, these cutting elements 2225 are fixed rigidly to blades protruding from the drill bit 2210. However, in alternate embodiments, analogous cutting elements may be secured to rotatable cones or other moving parts. Either the working end 2221 itself, or the drill bit 2210 secured thereto, may have a maximum cutting element 2226 that protrudes farther from the axis 2223 than any of the other cutting elements 2225 that side of the dynamic element 2224. However, the dynamic element 2224, at the limit of its extension, may be extendable farther from the axis 2223 than the maximum cutting element 2226.

Figure 13:
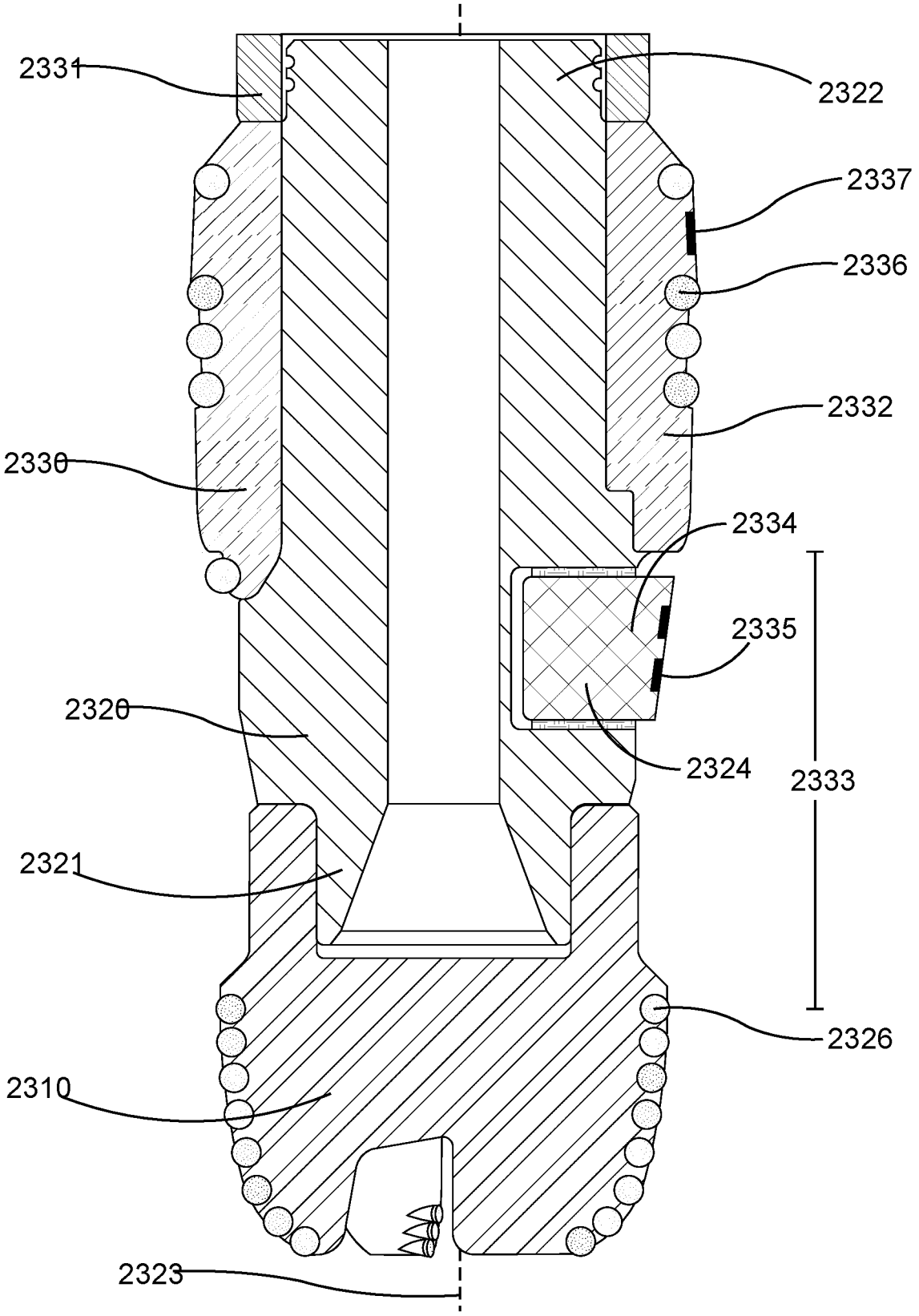
FIG. 13 is a longitude-sectional view of an embodiment of drilling tool comprising a hollow sleeve radially encompassing an elongate body.

FIG. 13 shows another embodiment of a drilling tool comprising an elongate body 2320. A hollow sleeve 2330 may be slid over an attachment end 2322 of this elongate body 2320 to radially encompasses the attachment end 2322. A drill string 2331 may then be secured to the attachment end 2322 and thereby restrain axial translation of the hollow sleeve 2330 relative to the body 2320.

This hollow sleeve 2330 may have one or more protrusions 2332 radially protruding therefrom. These protrusions 2332 may ride against an inner wall of a surrounding borehole (not shown) at certain points and degrade the inner wall at others. Specifically, at least one additional cutting element 2336, capable of degrading earthen materials, may be exposed on the protrusions 2332 of the hollow sleeve 2330 to engage an adjacent inner wall. Both this riding and degrading may wear on the protrusions 2332. When worn or damaged, the hollow sleeve 2330 may be quickly replaced by removing the drill string 2331 and sliding the sleeve 2330 off the elongate body 2320. If more expensive components of the downhole tool are contained within the elongate body 2320, rather than within the hollow sleeve 2330, the cost of their replacement may be minimized by replacing only the sleeve 2330.

Rapid replacement of the hollow sleeve 2330 may also allow for sleeves having different properties to be used interchangeably. As a simple example, the current hollow sleeve 2330 could be replaced with a sleeve of different size for use in a different sized borehole. In some circumstances, these differing-property sleeves may be rapidly produced, such as by 3D printing for example, to meet specific needs as they arise.

The protrusions 2332 may protrude from the hollow sleeve 2330 within 3 inches axially 2333 from a maximum cutting element 2326 disposed on either a working end 2321 of the elongate body 2320 or a drill bit 2310 secured to the working end 321. This maximum cutting element 2326 may protrude farther from an axis 2323 of the body 2320 than any other cutting element on that end of the body 2320. In the embodiment shown, the drill bit 2310 has a box connector capable of receiving a pin connector of the elongate body 2320. However, in alternate embodiments this arrangement may be reversed with a pin connector protruding axially from a drill bit received within a box connector of an elongate body.

A dynamic element 2324 may be radially extendable from a side of the elongate body 2320 at a position spaced axially between the attachment end 2322 and the working end 2321. In the embodiment shown, this dynamic element 2324 includes a piston 2334 translatable by pressurized drilling fluid traveling through the elongate body 2320 and temporarily enclosed within a cavity thereof. However, in alternate embodiments, analogous dynamic elements may be extendable from an elongate body via pressurized closed-circuit hydraulic oil, electrical means such as a solenoid coil, mechanical means such a rotating cam, or other methods. In some embodiments, the dynamic element 2324 and/or the piston 2334 may include the piston and extendable cutting elements as described in U.S. patent application Ser. No. 16/216,966, which is incorporated by reference herein in its entirety for all purposes. As also seen in this embodiment, the dynamic element 2324 may include at least one sensor 2335 embedded therein. Readings from this sensor 2335 may benefit from being pressed by the dynamic element 2324 against an inner wall of a surrounding borehole (not shown).

Referring back to the embodiment shown in FIG. 12, the working end 2221 of the elongate body 2220, or a drill bit 2210 secured to the working end 2221, may include a plurality of blades 2228 protruding both radially and axially therefrom. In some embodiments, such as the one shown, these blades 2228 may be spaced circumferentially about the axis 2223 such that one of them aligns with the dynamic element 2224 and a radial protrusion 2232 protruding from a hollow sleeve 2230. It is believed that such circumferential alignment may allow drilling fluid, ejected from the drilling tool, to flow smoothly past the blades 2228, dynamic element 2224 and radial protrusion 2232. This smooth drilling fluid flow may clean and cool cutting elements exposed on the blades 2228, dynamic element 22224 and radial protrusion 2232 of the sleeve 2230.

FIG. 14 shows embodiments of a hollow sleeve 2430 capable of being slid over an attachment end 2422 of an elongate body 2420 to radially encompass the attachment end 2422. Both the hollow sleeve 2430 and elongate body 2420 may have interlocking features that interact with each other to rotationally align the sleeve 2430 relative to the body 2420 and hold them in this relative alignment. For example, in the embodiment shown, the hollow sleeve 2430 has a plurality of keys 2440 protruding axially from locations spaced circumferentially about the sleeve 2430. As the hollow sleeve 2430 is slid over the attachment end 2422 of the elongate body 2420, the sleeve 2430 may be rotated until these keys 2440 fit into a plurality of mating slots 2441 formed into the body 2420. In this way, rotational orientation of the hollow sleeve 2430 may be have a controlled circumferential position relative to the extendable piston of the elongate body 2420. That is, the hollow sleeve 2430 may be clocked in a desired position relative to the elongate body. The keys 2440 and slots 2441 may facilitate desired alignment of the hollow sleeve 2430 with the dynamic element 2424 and/or blades 2228 of the drill bit 2210.

These keys 2440 may also function to place wear parts of the hollow sleeve 2430 closer to dynamic elements 2424 of the elongate body 2420. For example, additional cutting elements 2442 may be exposed on the keys 2440 of the sleeve 2430 such that they axially overlap the slots 2441 of the body 2420 when assembled. In such a configuration, if these additional cutting elements 2442 become worn or damaged the hollow sleeve 2430 may be replaced without requiring replacement of the elongate body 2420. Various arrangements of the keys 2440 and the slots 2441 may be configured to connect the hollow sleeve 2430 with the elongate body 2420. For example, the elongate body 2420 may have one or more keys 2440, and the hollow sleeve 2430 may have one or more respective slots 2441. Additionally, or in the alternative, the hollow sleeve 2430 may be coupled to the elongate body 2420 via detents, pins, fasteners, or fused material (e.g., weld).

Figure 15:
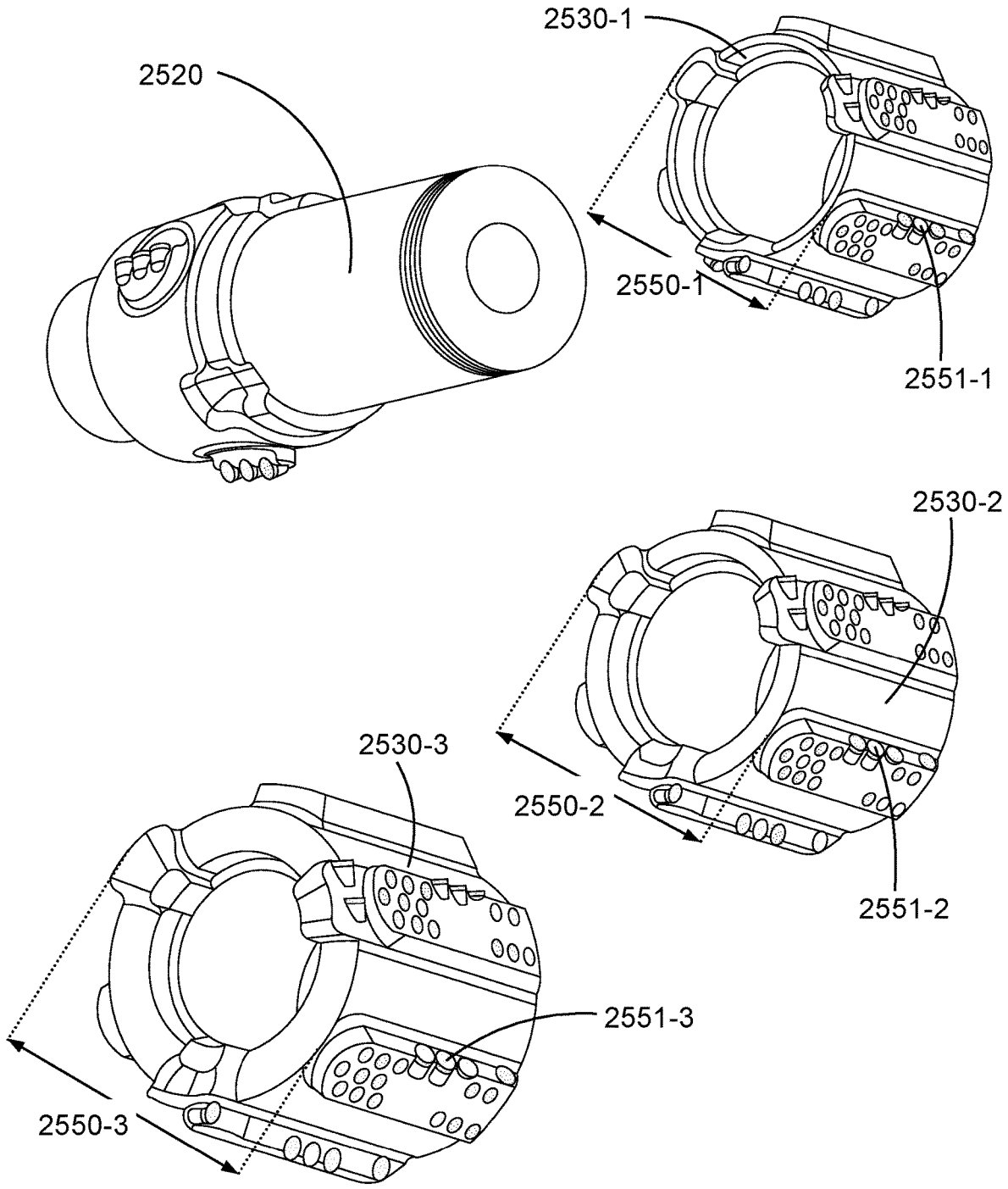
FIG. 15 is a perspective view of embodiments of several hollow sleeves each capable of radially encompassing an elongate body.

One of the advantages of a subterranean drilling tool comprising a hollow sleeve slid over an elongate body is that a variety of borehole sizes may be readily accommodated. Specifically, differing sizes of hollow sleeves may be employed at different times to accommodate different borehole sizes without altering the underlying elongate body. For example, FIG. 15 shows several embodiments of hollow sleeves 2530 1, 2530 2 and 2530 3 that each may be slid over a common elongate body 2520 at different times. Each of these hollow sleeves 2530 1, 2530 2 and 2530 3 may have a unique maximum radial dimension 2550 1, 2550 2 and 2550 3 such that each may fit snuggly within a differently sized borehole. Further, each of the hollow sleeves 2530 1, 2530 2 and 2530 3 may have an additional cutting element 2551 1, 2551 2 and 2551 3 exposed at its respective maximum radial dimension 2550 1, 2550 2 and 2550 3 capable of enlarging a surrounding borehole to that size.

Extendable Elements from Drilling Tool Sleeve

A downhole drilling tool, forming part of a subterranean drilling system, may include a hollow sleeve radially encompassing an elongate body. At least one dynamic element may be radially extendable from the hollow sleeve. A valve, housed within the elongate body, may direct pressurized drilling fluid traveling axially through the body to the dynamic element. In various configurations, this fluid flow may act to extend or retract the dynamic element.

If this radially-extendable element becomes worn or damaged, the hollow sleeve may be easily replaced. More expensive components of the downhole tool may be contained within the elongate body, rather than the hollow sleeve, and thus not require replacement as often. Additionally, a hollow-sleeve arrangement may allow for hollow sleeves of differing sizes to be employed at different times without altering the underlying elongate body.

In some embodiments, the hollow sleeve may be bolted to a shoulder of the elongate body to hold it in place. In others, a drill bit may be secured to one end of the elongate body and compress the hollow sleeve against the body. In some configurations, this drill bit may have multiple surfaces, one to press against the elongate body and another to press against the hollow sleeve. The surface pressed against the elongate body may help to prevent excessive compression of the sleeve. In other configurations, one surface of the drill bit may press axially against a compression member that may absorb some of the pressure on the sleeve or against a load member allowing compressive forces to bypass the sleeve.

Further, both hollow sleeve and elongate body may include interlocking elements that align the sleeve rotationally relative to the body and hold it rotationally in place.

Figure 16:
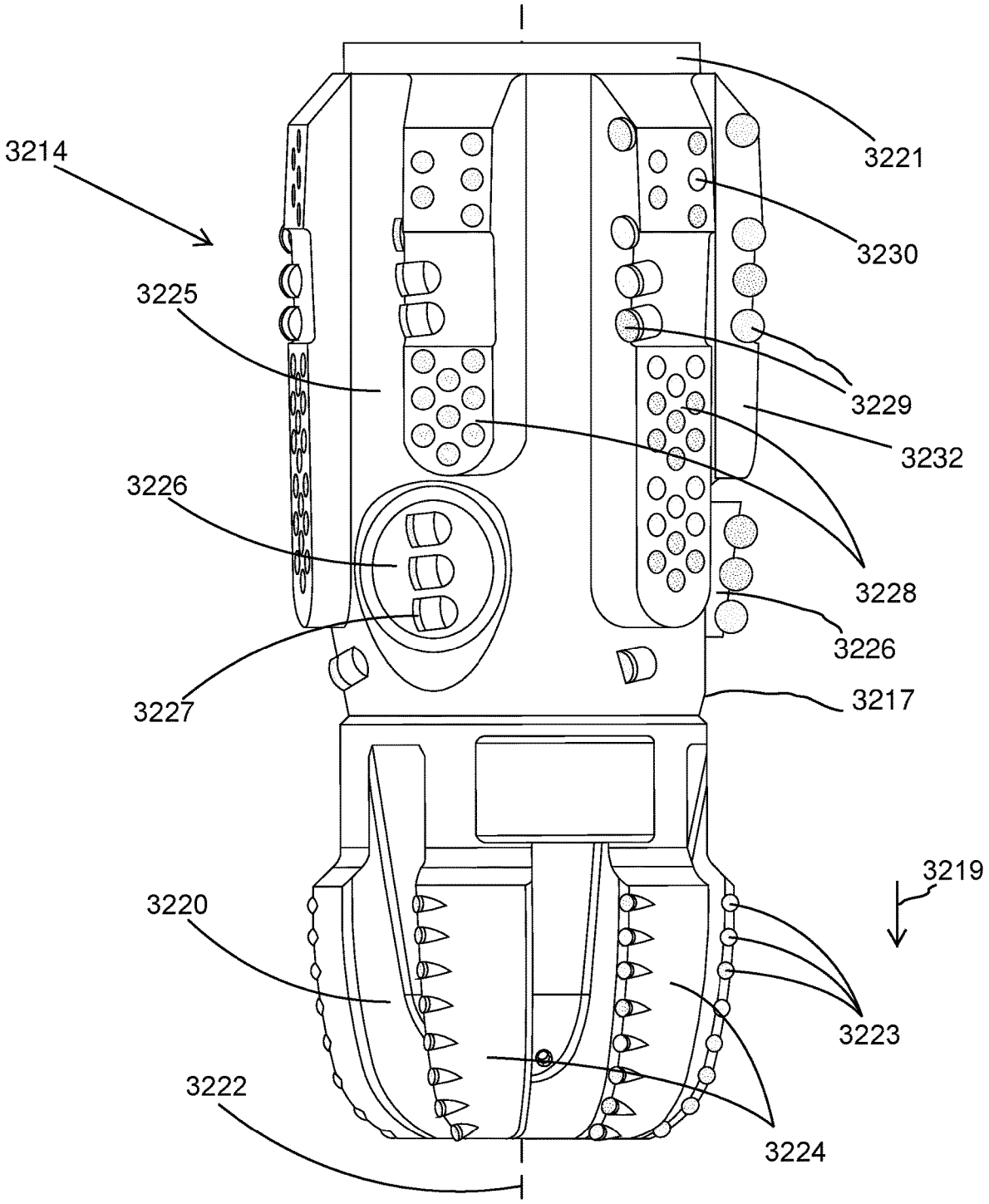
FIG. 16 is an orthogonal view of an embodiment of subterranean downhole tool having a hollow sleeve radially encompassing an elongate body.

FIG. 16 shows an embodiment of subterranean downhole tool 3214 (e.g., drilling tool) that could form part of a subterranean drilling operation as just described. This downhole tool 3214 may include a drill bit 3220 secured to a distal end of an elongate body 3221 such that both drill bit 3220 and elongate body 3221 may rotate about a common axis 3222 passing lengthwise through both. That is, the drill bit 3220 may be coupled to a working end 3217 of the elongate body 3221 in a downhole direction 3219. The drill bit 3220 may include assorted cutting surfaces 3223 exposed thereon. These cutting surfaces 3223 may be capable of degrading tough earthen materials to form a borehole therethrough as the drill bit 3220 is rotated. In the embodiment shown, these cutting surfaces 3223 are fixed rigidly to a plurality of blades 3224 each protruding radially and axially from the drill bit 3220 and spaced circumferentially thereabout. In alternate embodiments however, analogous cutting surfaces may be secured to rotatable cones or other moving parts of a tool coupled to the elongate body 3221.

The downhole tool 3214 may also have a hollow sleeve 3225 radially encompassing at least a portion of the elongate body 3221. This hollow sleeve 3225 may include at least one dynamic element 3226 radially extendable from a side thereof. In some embodiments, the hollow sleeve 3225 may have two or more dynamic elements 3226. In some embodiments, such a dynamic element 3226 may include a smooth exposed surface capable of pushing off an inner wall of a surrounding borehole when the dynamic element 3226 is extended. In the present embodiment, however, the dynamic element 3226 includes at least one dynamic cutting surface 3227 protruding from an exposed surface thereof. The dynamic element 3226 may be controlled to extend the dynamic cutting surface 3227 to dig into an inner wall of a surrounding borehole at certain times and rotational orientations. When the dynamic element 3226 is fully extended while the downhole tool 3214 rotates about the axis 3222, this dynamic cutting surface 3227 may extend farther radially from the axis 3222 than all the cutting surfaces 3223 fixed to the drill bit 3220 or cutting surfaces 3223 in the downhole direction 3219 of the dynamic element 3226. That is, the dynamic element 3226 is configured to enlarge the borehole when the dynamic element 3226 is extended. The dynamic element 3226 may be controlled to selectively enlarge a portion of the borehole.

The hollow sleeve 3225 may also have a plurality of blades 3228 each protruding radially therefrom and spaced circumferentially thereabout. A variety of cutting surfaces 3229 and wear pads 3230 may be fixed rigidly to exposed portions of each of these blades 3228 to degrade the borehole inner wall in some situations and ride against it without degrading it in others. Additionally, or in the alternative, hardfacing may be applied to the blades 3228 to improve the wear resistance of the blades 3228.

A wear surface 3232 of the one or more blades 3228 protrudes radially from the axis 3222 further than the dynamic cutting surfaces 3227 of the dynamic element 3226 when the dynamic element 3226 is retracted. In some embodiments, the dynamic cutting surfaces 3227 of the dynamic element 3226 protrude radially from the axis 3222 further than the wear surface 3232 when the dynamic element 3226 is extended from the hollow sleeve 3225. The one or more wear surfaces 3232 are configured to ride against the portions of the borehole uncut by the dynamic cutting surfaces 3227 when steering the downhole tool 3214. The cutting surfaces 3229 on the blades 3228 may enlarge the borehole to a desired diameter about the axis 3222.

In some embodiments, the downhole tool 3214 having the hollow sleeve 3225 is coupled to the drill bit 3220 such that the one or more components of the hollow sleeve 3225 are within a desired distance from the drill bit 3220. For example, the downhole tool 3214 may be configured such that the one or more dynamic elements 3226 are axially offset a distance from the outermost cutter of the drill bit 3220 between 0.25 to 5 times, 0.5 to 3 times, or 0.5 to 1.5 times the diameter of the drill bit 3220. In some embodiments, the downhole tool 3214 may be configured such that the wear surface 3232 of the blades 3228 are axially offset a distance from the outermost cutter of the drill bit 3220 between 0.25 to 7 times, 0.3 to 5 times, or 0.75 to 2 times the diameter of the drill bit 3220. Furthermore, in some embodiments, the distance of one or more components (e.g., wear surface 3232) of the hollow sleeve 3225 from the drill bit 3220 may affect the diameter of the drill bit 3220. That is, the distance between the wear surface 3232 of the hollow sleeve 3225 and the drill bit 3220 may inversely related to the diameter of the drill bit if a desired build angle or dogleg severity (DLS) is to be achieved by the downhole tool 3214.

Figure 17:
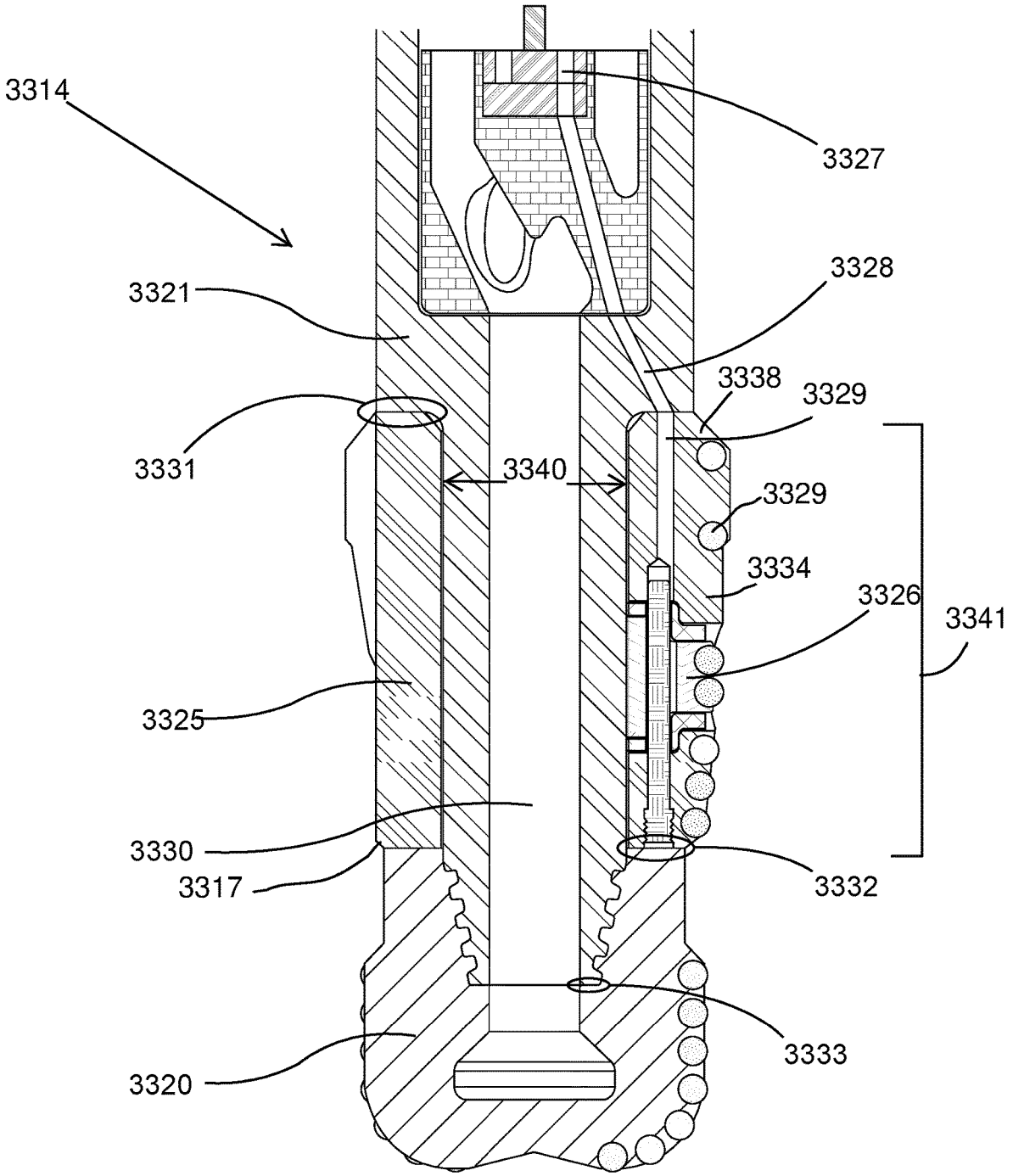
FIG. 17 is a longitude-sectional view of another embodiment of subterranean downhole tool having a hollow sleeve radially encompassing an elongate body.

FIG. 17 shows an embodiment of a subterranean downhole tool 3314 including a hollow sleeve 3325 radially encompassing a portion of an elongate body 3321. The elongate body 3321 may have a fluid channel 3330 passing axially therethrough allowing for drilling fluid to be conducted into a subterranean borehole. The elongate body 3321 may further have a shoulder 3331 disposed at some point along its length, transitioning from a first external diameter to a more narrow second external diameter 3340 of a sleeve receiving section 3341. The hollow sleeve 3325 may be disposed about the sleeve receiving section 3341. In some embodiments, the hollow sleeve 3325 is slid over one end (e.g., working end 3317) of the elongate body 3321 until it meets the shoulder 3331. The hollow sleeve 3325 may be axially restrained around the sleeve receiving section 3341 by the shoulder 3331 and another body of the drill string 114, such as the drill bit 3320, a pipe section, or downhole tool.

The drill bit 3320, or in alternate embodiments a pipe section or another tool, may be secured to the working end 3317 of the elongate body 3321. In the present embodiment, this drill bit 320 is secured to the elongate body 3321 via a threaded connection, however alternate embodiments may rely on alternate connection mechanisms between the drill bit 3320 and the elongate body 3321. Although FIG. 17 illustrates the connection as a box in the drill bit 3320 and a pin of the downhole tool 3314, it is appreciated that the downhole tool 3314 may be coupled to the drill bit 3320, other tools, or pipes via other connections. For example, the downhole tool 3314 may have a box connection and the drill bit 3320, drill pipe, or collar may have a pin connection. When secured to the elongate body 3321, the drill bit 3320, or other body, may restrain the hollow sleeve 3325 from sliding axially along the sleeve receiving section 3341 of the elongate body 3321.

In some embodiments, the component (e.g., drill bit 3320) coupled to the working end 3317 may compress the hollow sleeve 3325 axially between the shoulder 3331 and component. A double-shouldered feature of the component may control the amount of compressive pressure applied to the hollow sleeve 3325. For example, a first surface 3332 of the drill bit 3320 may interface axially against the hollow sleeve 3325. The amount of pressure applied by the first surface 3332 to the hollow sleeve 3325 may increase as the component (e.g., drill bit 3320) is coupled to the elongate body 3321. This pressure relationship may change, however, when a second surface 3333 of the component (e.g., drill bit 3320) contacts the elongate body 3321. Once this happens, additional pressure may be shared between the first surface 3332 and the second surface 3333. That is, the double-shouldered feature may reduce the compressive load on the sleeve 3325 and the components therein.

The hollow sleeve 3325 may have at least one controllable radially-extendable element. For example, the present embodiment includes a piston 3326, disposed within a cavity of the hollow sleeve 3325, that may extend radially from an exterior of the hollow sleeve 3325 when subjected to pressurized fluid within the cavity. While the present embodiment shows a single piston leading to a non-axially symmetrical configuration for the hollow sleeve 3325, alternate embodiments may include a plurality of pistons in various configurations along the axis and/or circumference of the downhole tool 3314. Pressurized drilling fluid may be channeled from the central fluid channel 3330 to the cavity of the hollow sleeve 3325 via a duct 3328. In some embodiments a valve 3327 housed within the elongate body 3321 is configured to route at least a portion of the drilling fluid to the duct 3328 in the elongate body 3320. The duct 3328 in the elongate body 3320 may be configured to route the drilling fluid to one or more dynamic element ducts 3329 of the hollow sleeve 3325. In the present embodiment, the piston 3326 is biased outwards and pressurized fluid transported through the duct 3328 may urge the piston 3326 to retract into the hollow sleeve 3325, however other configurations are also contemplated. Additionally, while the present embodiment includes a piston, alternate embodiments may have any of a variety of extendable mechanisms. In some embodiments, the piston 3326 of the sleeve 3325 may include the piston and extendable cutting elements as described in U.S. patent application Ser. No. 16/216,966, which is incorporated by reference herein in its entirety for all purposes.

Extending the dynamic element 3326 from the hollow sleeve 3325, rather than directly from an elongate body, may provide several advantages. For instance, if the extendable element becomes worn or damaged the hollow sleeve may be quickly replaced by removing the drill bit or other securing body. If more expensive components of a downhole tool, such as electronics or valving, are contained within an elongate body, rather than a hollow sleeve, the cost of such a replacement may be minimized. Additionally, a hollow-sleeve arrangement may allow for hollow sleeves of differing sizes to be employed at different times without altering the underlying elongate body and the size 3340 of the sleeve receiving section 3341. This may allow not only for different borehole sizes but also to accommodate for worn parts. For example, a first hollow sleeve 3325 having one or more respective dynamic elements with a first radial extension may be utilized with the same elongate body of the downhole tool 3314 as a second hollow sleeve 3325 having one or more respective dynamic elements with a second radial extension that is greater than the first radial extension.

Additionally, or in the alternative, the size of the wear surfaces 3334 and/or the cutting surfaces 3329 on blades 3338 may vary among multiple hollow sleeves 3325 configured to be used with the same elongate body 321 to facilitate use of the downhole tool 3314 in various hole sizes. In some embodiments, a particular hollow sleeve 3325 with a desired radial extension of a dynamic element 3326 and parameters of the blades 3328 may be selected for use with an elongate body to provide a desired build angle or steering characteristic for the downhole tool 3314.

Figure 18:
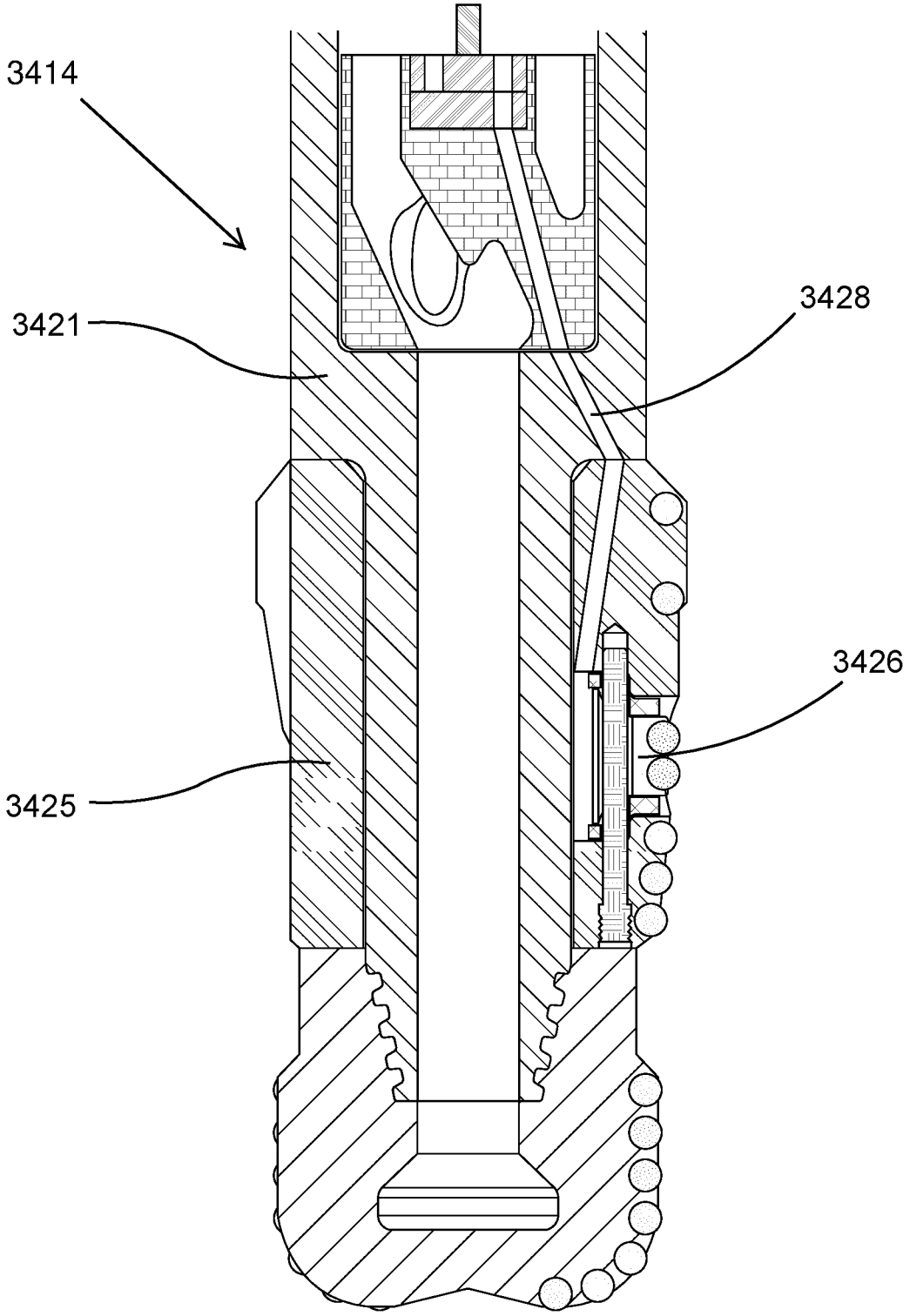
FIG. 18 is a longitude-sectional view of another embodiment of subterranean downhole tool having a hollow sleeve radially encompassing an elongate body.

FIG. 18 shows another embodiment of a subterranean downhole tool 3414 having a hollow sleeve 3425 radially encompassing an elongate body 3421. Like the previous embodiment shown, the hollow sleeve 3425 of the present embodiment includes a piston 3426 radially extendable from an exterior thereof. However, in this embodiment, the piston 3426 is biased inwards and controlled flow of pressurized fluid transported through a duct 428 from the elongate body 3421 may urge the piston 3426 to extend outward.

Figure 19:
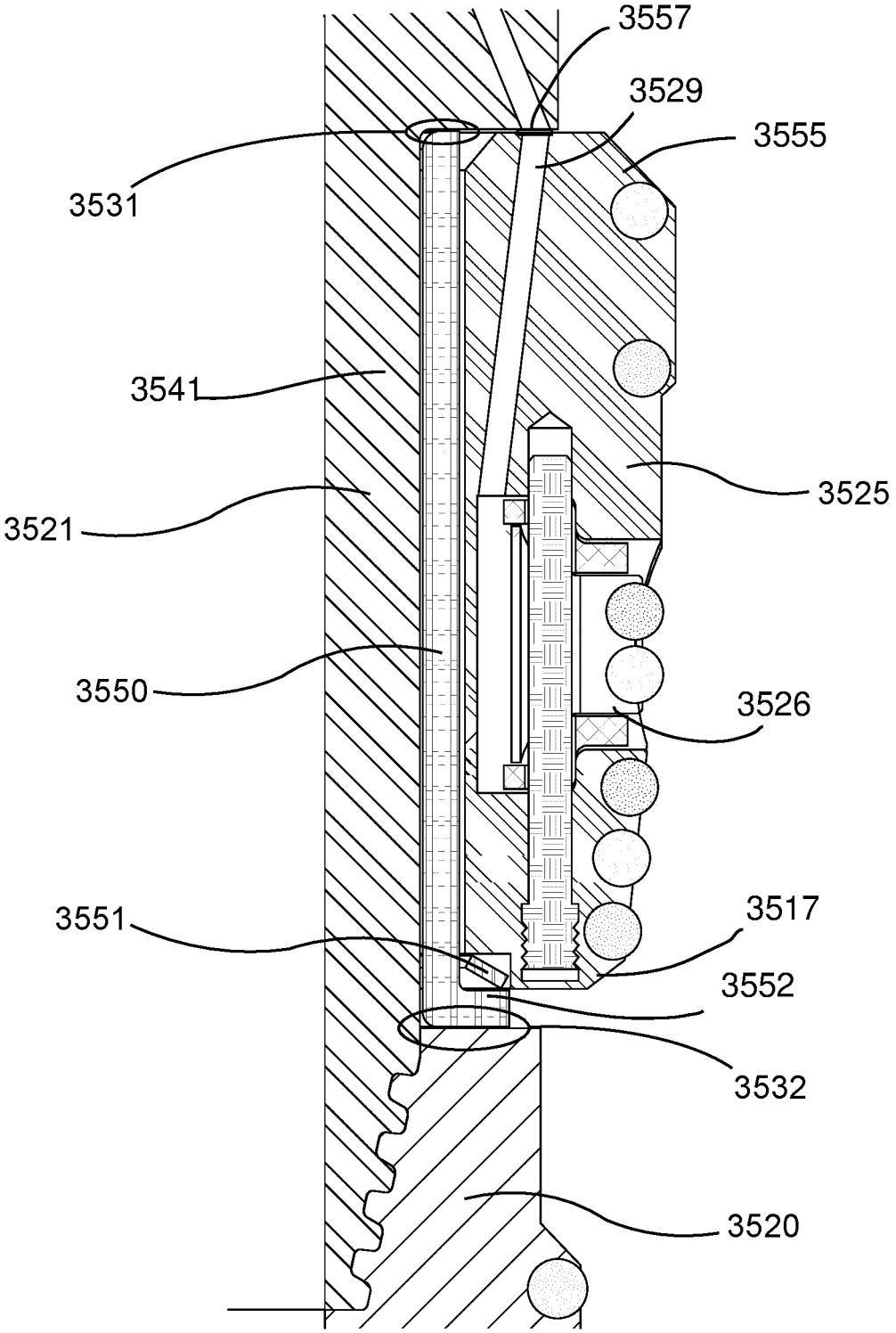
FIG. 19 is a partial longitude-sectional view of an embodiment of a load member bypassing a hollow sleeve.

While the embodiments shown in FIGS. 17 and 18 have drill bits axially compressing hollow sleeves, some embodiments of the downhole tool may be configured to reduce compression of the hollow sleeve and its respective components (e.g., dynamic element, blades, ducts). Reducing compression of the hollow sleeve may facilitate movement of the dynamic element regardless of loading by the component coupled to the downhole tool. FIG. 19 shows an embodiment of a hollow sleeve 3525 that may be at least partially shielded from compression by a load member 3550. Specifically, a component 3520 (e.g., drill bit 3520, downhole tool) of the drill string may include a surface 3532 pressed axially against a load member 3550. It is believed that forming this load member 3550 from a dissimilar material, or at least a material having a different hardness, from that of the drill bit 3520 may help to prevent galling. This load member 3550 may be further axially pressed against an elongate body 3521 at a shoulder 3531 thereof. Such an arrangement of the load member 3550 between the shoulder 3531 of the elongate body 3521 and the component 3520 may facilitate the load member 3550 to shield the hollow sleeve 3525 from at least some of the axial compression from the component 3520.

In some embodiments, the load member 3550 may be inserted within the hollow sleeve 3525. A support surface 3552 of the load member 3550 may support the end of the hollow sleeve 3525, such as the working end 3517 of the hollow sleeve 3525. The load member 3550 may be disposed about the sleeve receiving section 3541 of the elongate body 3521, with the hollow sleeve 3525 radially encompassing the load member 3550 and the sleeve receiving section 3541 along one or more axial points along the elongate body 3521. In some embodiments, an inlet end 3555 The hollow sleeve 3525 In some embodiments, one or more seals 3557 may be disposed between the inlet end 3555 of the hollow sleeve 3525 and the elongate body 3521, thereby facilitating flow of the drilling fluid through the duct 3529 to actuate the dynamic element 3526.

The embodiment shown in FIG. 19 also includes a compression member 3551 disposed between the support surface 3552 of the load member 3550 and the hollow sleeve 3525. This compression member 3551, shown in the form of a Belleville washer in this embodiment but capable of a variety of alternate forms, may absorb some compressive force and thereby regulate an amount of axial pressure transferred from the load member 3550 to the hollow sleeve 3525.

Figures 1, 20:
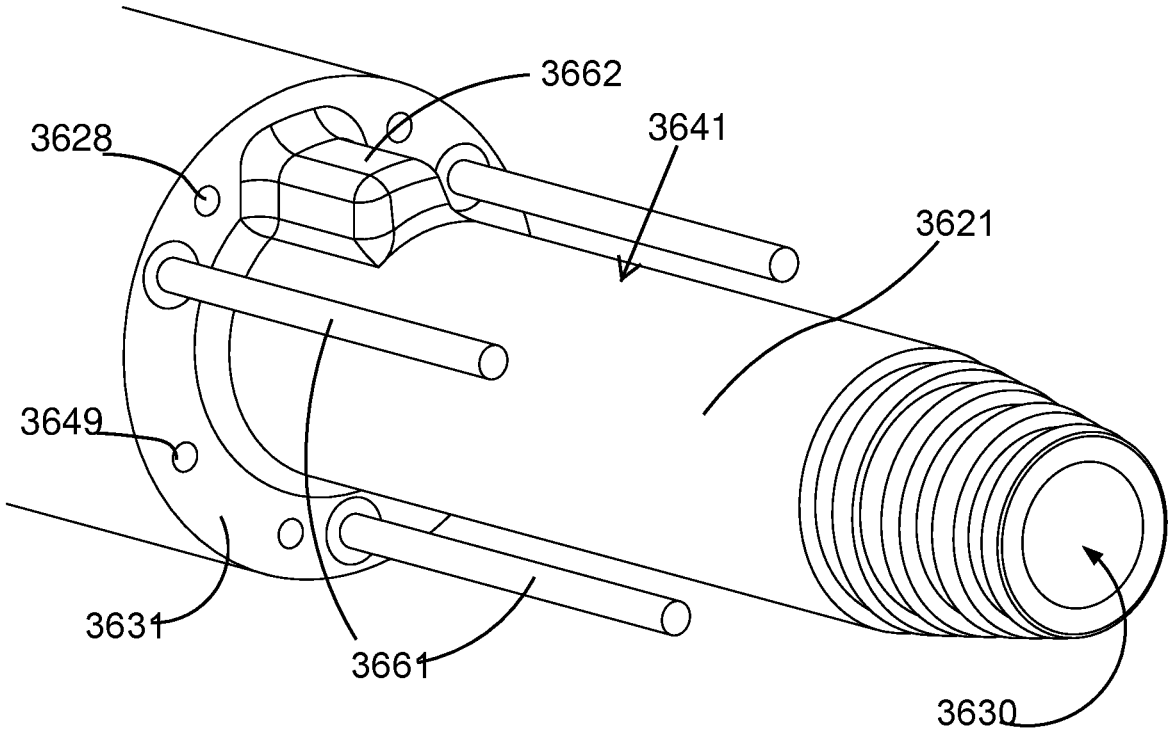
Figures 2, 20:
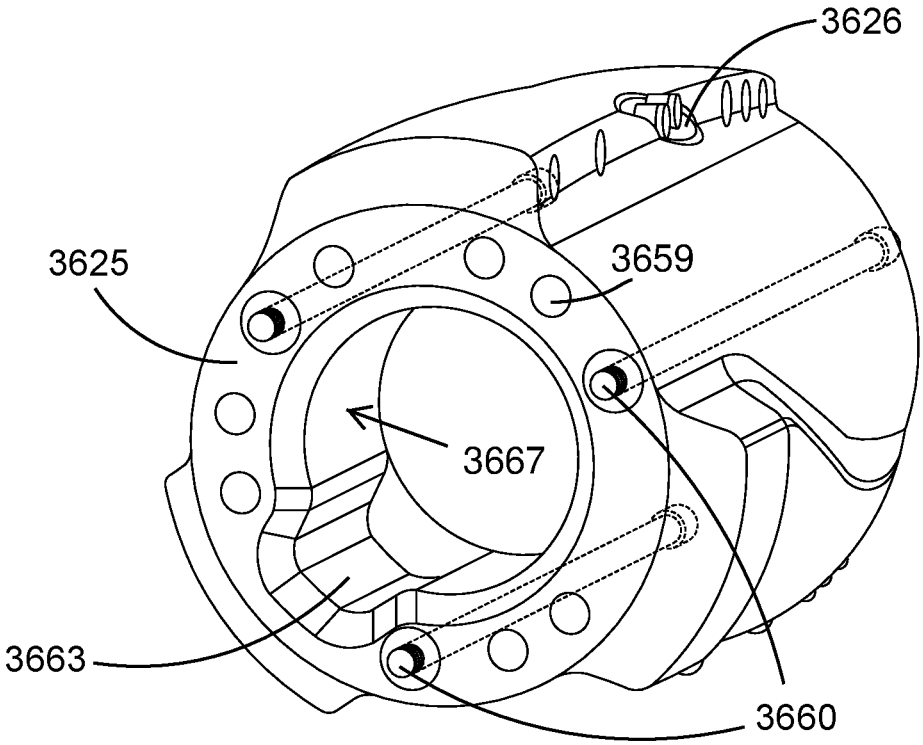

FIG. 20-1 shows an embodiment of an elongate body 3621 of a type that could form part of a subterranean downhole tool. Like embodiments described earlier, this elongate body 3621 may include a fluid channel 3630 passing axially therethrough and an external shoulder 3631 disposed at a certain point along its length, transitioning from a first radial dimension to a second radial dimension at the sleeve receiving section 3641 that is smaller than the first radial dimension. One or more ports 3628 of the elongate body 3621 may be configured to supply at least a portion of the drilling fluid to a hollow sleeve 3625 to actuate the dynamic elements 3626 thereon. FIG. 20-2 shows an embodiment of the hollow sleeve 3625 of a type that could also form part of a subterranean downhole tool. Such a hollow sleeve 3625 could be slid over the sleeve receiving section 3641 of the elongate body 3621 until it meets the shoulder 3631 thereof. In these embodiments, the hollow sleeve 3625 may be secured to the elongate body 3621, and specifically to the shoulder 3631 of the elongate body 3621, via a plurality of bolts 3660. These bolts 3660 may pass through holes formed in the hollow sleeve 3625 and be threaded directly into connections 3649 on the shoulder 3631 of the elongate body 3621. However, a variety of different configurations are contemplated as alternate embodiments.

The elongate body 3621 shown in FIG. 20-1 further includes a plurality of sensors 3661 protruding therefrom. These sensors 3661 may protrude axially from the shoulder 3631 of the elongate body 3621 such that they extend into holes 3659 formed within the hollow sleeve 3625 when the hollow sleeve 3625 is slid over the elongate body 3621. Positioning these sensors 3661 within holes 3659 formed into the hollow sleeve 3625 may allow them to more accurately measure movement of a radially-extendable element 3626 forming part of the hollow sleeve 3625 or the resulting effects of such movement. In some embodiments, the sensors 3661 may be physically close to the radially-extendable element 3626 while still being communicatively coupled (e.g., electrically wired) to the elongate body 3621, thus avoiding having to communicate electrically between the elongate body 3621 and the hollow sleeve 3625.

The elongate body 3621 shown in FIG. 20-1 and the hollow sleeve 625 shown in FIG. 20-2 may also have interfacing geometries (i.e., mating geometries, complementary geometries) that may restrict rotation of the hollow sleeve 3625 relative to the elongate body 3621. Specifically, in the embodiments shown, the elongate body 3621 has at least one tab 3662 protruding radially therefrom that may fit within an internal slot 3663 disposed within the hollow sleeve 3625. Sliding the hollow sleeve 3625 over the elongate body 3621, in a specific rotational orientation, may allow the tab 3662 to fit within the slot 3663, thus restricting relative rotation and easing stress on the bolts 3660. Furthermore, rotational alignment of the hollow sleeve 3625 may facilitate routing drilling fluid to the dynamic element from the elongate body 3621. This complementary tab 3662 and slot 3663 may further aid in rotationally aligning the hollow sleeve 3625 relative to the elongate body 3621 such that the bolts 3660 may more easily fit into their mating holes. Additionally, or in the alternative, complementary features (e.g., grooves, ridges) between the outer surface of the sleeve receiving section 3641 of the elongate body 3621 and the inner surface 3667 of the hollow sleeve 3625 may facilitate a specific rotational orientation of the hollow sleeve 3625 with the elongate body 3621. Furthermore, mating non-round (e.g., elliptical) surfaces of the sleeve receiving section 3641 and the inner surface 3667 of the hollow sleeve 3625 may facilitate a desired rotational alignment of the hollow sleeve with respect to the elongate body 3621. Additionally, the hollow sleeve 3625 may be arranged in a desired orientation about the elongate body 3621 to provide a desired alignment of the one or more dynamic elements of the hollow sleeve 3625 with features (e.g., blades, cones, hydraulic flow paths) of the component (e.g., drill bit) coupled to the working end 3617 of the elongate body 3621.

Figure 21:
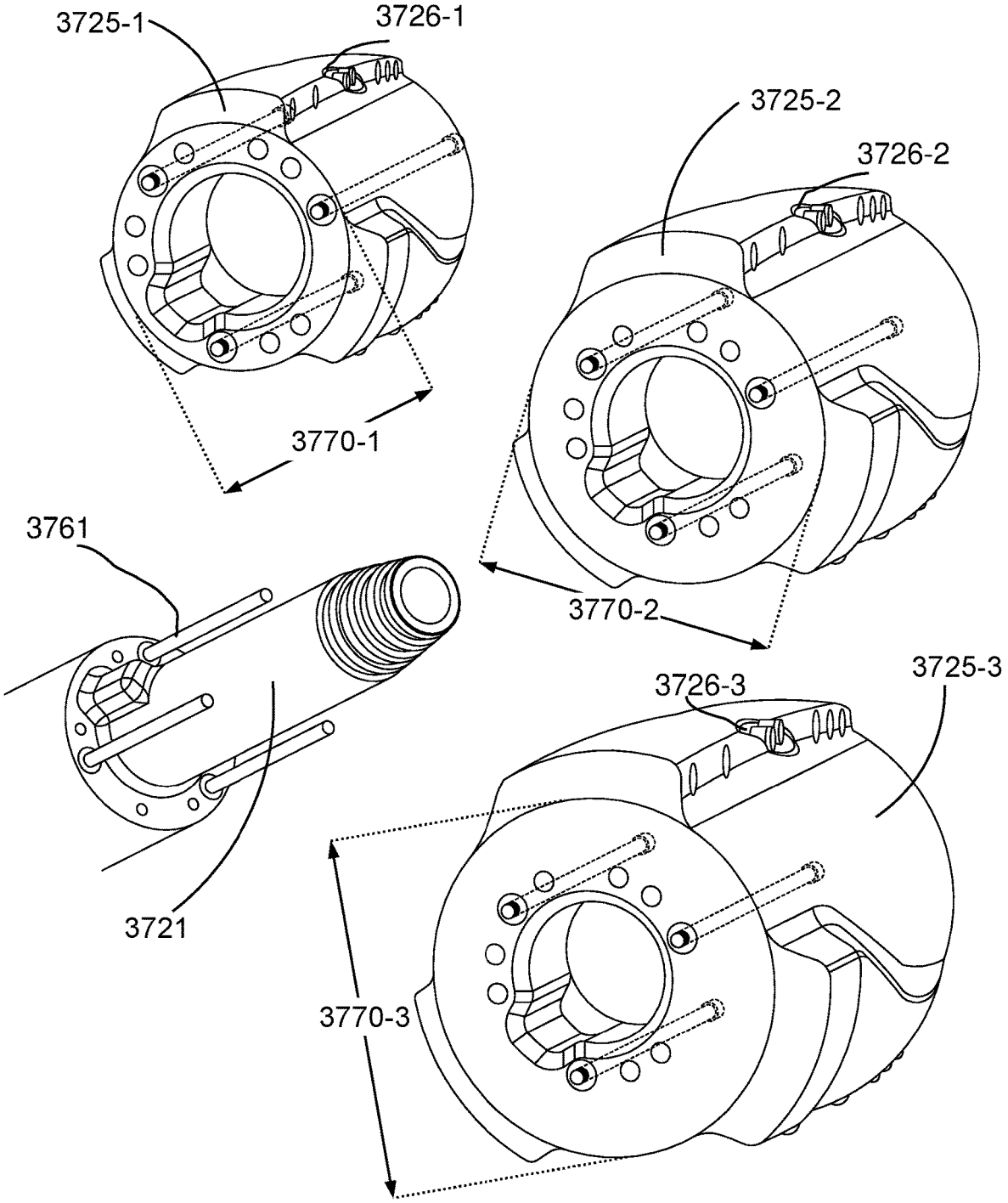
FIG. 21 is a perspective view of embodiments of an elongate body and a plurality of hollow sleeves.

One of the advantages that may be realized from a subterranean downhole tool having a hollow sleeve slid over an elongate body is that a variety of borehole sizes may be readily accommodated. For example, FIG. 21 shows several embodiments of hollow sleeves 3725-1, 3725-2 and 3725-3 that each may be slid over a common elongate body 3721. Each of these hollow sleeves 3725-1, 3725-2 and 3725-3 may have a different respective external diameter size 3770-1, 3770-2 and 3770-3 such that each may fit snuggly within a differently sized borehole. That is, the common elongate body 3721 may be selectively combined with each of the hollow sleeves 3725-1, 3725-2 and 3725-3 to form different downhole tools forming respectively sized boreholes. It is to be appreciated the hollow sleeves 3725 facilitate decoupling replacement of the blades 3728 and/or dynamic elements 3726 from the common elongate body 3721 with its sensors 3761 and respective components (e.g., electronics, valves). In some embodiments, each of the hollow sleeves 3725 may be utilized with a load member, as discussed above with FIG. 19.

Set forth below are some embodiments of the above disclosure:

Embodiment 1: A downhole tool having an elongate body, a plate secured to the body, an element radially extendable from the plate, and electronics disposed between the plate and the elongate body.

Embodiment 2: A downhole tool having an elongate body, a plate secured to the body, an element radially extendable from the plate, and electronics disposed between the plate and the elongate body. The plate is one of a plurality of plates each secured to the elongate body and spaced circumferentially thereabout.

Embodiment 3: A downhole tool having an elongate body, a plate secured to the body, an element radially extendable from the plate, and electronics disposed between the plate and the elongate body. The plate is one of a plurality of plates each secured to the elongate body and spaced circumferentially thereabout. Each plate is bolted to at least another plate through the elongate body.

Embodiment 4: A downhole tool having an elongate body, a plate secured to the body, an element radially extendable from the plate, and electronics disposed between the plate and the elongate body. The plate includes at least one cutting surface exposed on a leading edge thereof.

Embodiment 5: A downhole tool having an elongate body, a plate secured to the body, an element radially extendable from the plate, and electronics disposed between the plate and the elongate body. The plate is one of a plurality of plates, and each plate is capable of being alternately secured to the elongate body.

Embodiment 6: A downhole tool having an elongate body, a plate secured to the body, an element radially extendable from the plate, and electronics disposed between the plate and the elongate body. The plate is one of a plurality of plates, each plate is capable of being alternately secured to the elongate body, and each plate includes at least one cutting surface exposed on a leading edge thereof at a respective unique maximum radial dimension.

Embodiment 7: A downhole tool having an elongate body, a plate secured to the body, an element radially extendable from the plate, and electronics disposed between the plate and the elongate body. The radially extendable element includes a piston translatable by a pressurized fluid enclosed between the plate and the elongate body.

Embodiment 8: A downhole tool having an elongate body, a plate secured to the body, an element radially extendable from the plate, and electronics disposed between the plate and the elongate body. The radially extendable element includes at least one cutting surface exposed thereon.

Embodiment 9: A downhole tool having an elongate body, a plate secured to the body, an element radially extendable from the plate, and electronics disposed between the plate and the elongate body. The electronics are secured to the elongate body.

Embodiment 10: A downhole tool having an elongate body, a plate secured to the body, an element radially extendable from the plate, and electronics disposed between the plate and the elongate body. The plate is capable of wireless communication with the elongate body.

Embodiment 11: A downhole tool having an elongate body, a plate secured to the body, an element radially extendable from the plate, and electronics disposed between the plate and the elongate body. The plate is capable of wireless communication with the elongate body. The plate is detachable from the elongate body, attachable to a docking station, and capable of wireless communication with the docking station when attached thereto.

Embodiment 12: A downhole tool having an elongate body, a plate secured to the body, an element radially extendable from the plate, and electronics disposed between the plate and the elongate body. The downhole tool includes a valve secured to an exterior of the elongate body.

Embodiment 13: A downhole tool having an elongate body, a plate secured to the body, an element radially extendable from the plate, and electronics disposed between the plate and the elongate body. The downhole tool includes a valve secured to an exterior of the elongate body, and at least a portion of the valve is engaged with the plate.

Embodiment 14: A downhole tool having an elongate body, a plate secured to the body, an element radially extendable from the plate, and electronics disposed between the plate and the elongate body. The downhole tool includes a nozzle passing from an interior of the elongate body to an exterior thereof.

Embodiment 15: A downhole tool having an elongate body, a plate secured to the body, an element radially extendable from the plate, and electronics disposed between the plate and the elongate body. The plate includes at least one sensor housed therein.

Embodiment 16: A downhole tool having an elongate body, a plate secured to the body, an element radially extendable from the plate, and electronics disposed between the plate and the elongate body. The radially extendable element includes at least one sensor housed therein.

Embodiment 17: A method includes selecting a first plate comprising a first radially extendable element, arranging electronics between the first plate and an elongate body of a downhole tool, and attaching the first plate to the elongate body of the downhole tool. The downhole tool includes a first radial dimension when the first radially extendable element is retracted and a second radial dimension when the first radially extendable element is extended.

Embodiment 18: The method of Embodiment 17, further including removing the first plate from the elongate body, selecting a second plate having a second radially extendable element, arranging the electronics between the second plate and the elongate body of the downhole tool and attaching the second plate to the elongate body of the downhole too. The downhole tool includes third radial dimension when the second radially extendable element is retracted and a fourth radial dimension when the second radially extendable element is extended, wherein the third radial dimension is greater than the first radial dimension, and the fourth radial dimension is greater than the second radial dimension.

Embodiment 19: The method of Embodiment 17, further including removing the first plate with the electronics from the elongate body, coupling the first plate with a docking station, and communicating wirelessly between the electronics of the first plate and the docking station.

Embodiment 20: The method of Embodiment 17, further including attaching a plurality of plates to be circumferentially spaced about the elongate body of the downhole too, wherein each plate of the plurality of plates includes the first plate.

Embodiment 21: A steerable downhole tool includes a stator, a rotor rotatable relative to a stator, and a sensor capable of detecting a rotational orientation of the stator while the stator is held stationary. The rotor includes a dynamic element radially extendable from the rotor while the stator is rotated.

Embodiment 22: The steerable downhole tool of Embodiment 21, wherein the stator is disposed toward a proximal end of the steerable downhole tool. The stator includes at least one protrusion radially projecting from the stator. The dynamic element of the rotor is disposed toward a distal end of the steerable downhole tool, and the rotor includes at least one cutting surface fixed to an exterior of the rotor.

Embodiment 23: The steerable downhole tool of Embodiment 21, wherein the downhole tool includes at least one cutting surface fixed to an exterior of the radially-extendable element.

Embodiment 24: The steerable downhole tool of embodiment 21, wherein the rotor includes at least one of a processor, a data storage, a battery, a capacitor, a turbine and a valve.

Embodiment 25: The steerable downhole tool of embodiment 21, wherein the stator radially encompasses an axial section of the rotor toward a proximal end of the steerable downhole tool.

Embodiment 26: The steerable downhole tool of embodiment 21, wherein the rotor comprises at least one nozzle passing from an interior of the rotor to an interior of the stator.

Embodiment 27: The steerable downhole tool of embodiment 26, wherein the rotor includes a valve capable of channeling fluid alternatingly to the nozzle and the radially-extendable element.

Embodiment 28: The steerable downhole tool of embodiment 21, wherein the rotor includes a valve capable of channeling fluid to the radially-extendable element.

Embodiment 29: A method for steering a downhole tool includes providing a rotor rotatable relative to a stator, detecting with a sensor of the downhole tool, a rotational orientation of the stator while holding the stator rotationally stationary, and extending an element radially from the rotor while the stator is rotated.

Embodiment 30: The method of embodiment 29, further including extending the element in a first radial direction corresponding to the rotational orientation sensed.

Embodiment 31: The method of embodiment 30, wherein extending the element urges the rotor in a second radial direction opposite the first radial direction.

Embodiment 32: The method of embodiment 30, wherein extending the element removes material from a surrounding formation in the first radial direction corresponding to the rotational orientation sensed.

Embodiment 33: The method of embodiment 29, wherein the stator is disposed on one end of a drill string and holding the stator rotationally stationary comprises holding the drill string rotationally stationary at an opposing end thereof.

Embodiment 34: The method of embodiment 33, further including rotationally orienting the stator from the opposing end of the drill string.

Embodiment 35: The method of embodiment 29, further including storing the detected rotational orientation in data storage forming part of the downhole tool.

Embodiment 36: The method of embodiment 29, further including axially lifting the stator while detecting the rotational orientation.

Embodiment 37: The method of embodiment 29, further including detecting a time duration that the stator is held rotationally stationary from the rotor and extending the element an arc length corresponding to the time duration detected.

Embodiment 38: The method of embodiment 29, further including transporting fluid through the rotor and stator, detecting a time duration that the fluid is transported from the rotor, and extending the element an arc length corresponding to the time duration detected.

Embodiment 39: A downhole tool includes an elongate body having a working end opposite from an attachment end and rotatable about an axis passing lengthwise therethrough. The downhole tool includes a dynamic element radially extendable from the body and positioned axially between the working end and the attachment end. The downhole tool includes a maximum cutting element exposed on the working end of the body, or on a drill bit attached to the working end, and protruding farther from the axis than any other cutting element that side of the dynamic element. The downhole tool includes a hollow sleeve radially encompassing the attachment end of the body. The downhole tool includes at least one protrusion radially protruding from the hollow sleeve within a distance (e.g., 3 inches, less than 50% of the drill bit radius) axially from the maximum cutting element.

Embodiment 40: The downhole tool of embodiment 39, wherein the dynamic element is extendable via fluid pressure.

Embodiment 41: The downhole tool of embodiment 39, wherein the dynamic element includes a cutting element exposed thereon.

Embodiment 42: The downhole tool of embodiment 39, wherein the dynamic element includes at least one sensor embedded therein.

Embodiment 43: The downhole tool of embodiment 39, wherein the dynamic element is removable from the elongate body and replaceable.

Embodiment 44: The downhole tool of embodiment 39, wherein the dynamic element is extendable farther from the axis than the maximum cutting element.

Embodiment 45: The downhole tool of embodiment 39, wherein the dynamic element is aligned circumferentially with the radial protrusion of the hollow sleeve.

Embodiment 46: The downhole tool of embodiment 39, further including at least one blade radially and axially protruding from the working end of the body, or from a drill bit attached to the working end; wherein the blade is aligned circumferentially with the radial protrusion of the hollow sleeve.

Embodiment 47: The downhole tool of embodiment 39, wherein the hollow sleeve includes a cutting element exposed thereon.

Embodiment 48: The downhole tool of embodiment 47, wherein the cutting element of the hollow sleeve is exposed on the radial protrusion of the hollow sleeve.

Embodiment 49: The downhole tool of embodiment 39, wherein a rotational orientation of the hollow sleeve is clocked relative to the body.

Embodiment 50: The downhole tool of embodiment 39, wherein the body and hollow sleeve include interlocking features restricting rotation of the hollow sleeve relative to the body.

Embodiment 51: The downhole tool of embodiment 50, wherein the interlocking features rotationally align the hollow sleeve relative to the body.

Embodiment 52: The downhole tool of embodiment 50, wherein the interlocking features of the hollow sleeve include a cutting element exposed thereon that axially overlaps the interlocking features of the body.

Embodiment 53: The downhole tool of embodiment 39, wherein the hollow sleeve is slidable over the attachment end of the body.

Embodiment 54: The downhole tool of embodiment 53, further including a drill string secured to the attachment end of the body and restraining axial translation of the hollow sleeve.

Embodiment 55: The downhole tool of embodiment 39, wherein the hollow sleeve is one of a plurality of hollow sleeves each capable of radially encompassing the attachment end of the body.

Embodiment 56: The downhole tool of embodiment 55, wherein each of the plurality of hollow sleeves includes a unique maximum radial dimension.

Embodiment 57: The downhole tool of embodiment 56, wherein a cutting element is exposed at the unique maximum radial dimension of each of the plurality of hollow sleeves.

Embodiment 58: The downhole tool of embodiment 55, wherein each of the plurality of hollow sleeves is capable of alternatingly encompassing the body.

Embodiment 59: A downhole tool having an elongate body with a sleeve receiving section along a portion of an axial length, a hollow sleeve radially encompassing the sleeve receiving section of the elongate body, and an element radially extendable from the hollow sleeve.

Embodiment 60: The downhole tool of embodiment 59, wherein the radially-extendable element comprises a piston translatable by pressurized fluid.

Embodiment 61: The downhole tool of embodiment 59, further including a duct capable of transporting pressurized fluid from the elongate body to the hollow sleeve.

Embodiment 62: The downhole tool of embodiment 60, wherein the element is radially extendable from the hollow sleeve by pressurized fluid transported through the duct.

Embodiment 63: The downhole tool of embodiment 60, wherein the element is radially retractable into the hollow sleeve by pressurized fluid transported through the duct.

Embodiment 64: The downhole tool of embodiment 60, further including a valve, housed within the elongate body, capable of controlling fluid flow through the duct.

Embodiment 65: The downhole tool of embodiment 59, wherein the hollow sleeve is non-axially symmetrical.

Embodiment 66: The downhole tool of embodiment 59, further including a second body secured to one end of the elongate body and restraining axial translation of the hollow sleeve Embodiment 67: The downhole tool of embodiment 66, wherein the second body is secured to the elongate body by threads.

Embodiment 68: The downhole tool of embodiment 66, wherein the second body includes a first surface pressed axially against the hollow sleeve and a second surface pressed axially against the elongate body.

Embodiment 69: The downhole tool of embodiment 66, wherein the second body includes a surface pressed axially against a load member that is further pressed axially against the elongate body.

Embodiment 70: The downhole tool of embodiment 66, wherein the elongate body includes a shoulder opposite the second body, wherein the hollow sleeve is axially restrained between the shoulder and the second body.

Embodiment 71: The downhole tool of embodiment 70, wherein the hollow sleeve is axially compressed between the second body and the shoulder.

Embodiment 72: The downhole tool of embodiment 71, further including a compression member regulating axial compression of the hollow sleeve.

Embodiment 73: The downhole tool of embodiment 59, further including a sensor protruding from the elongate body into the hollow sleeve.

Embodiment 74: The downhole tool of embodiment 59, wherein the hollow sleeve is bolted to the elongate body.

Embodiment 75: The downhole tool of embodiment 74, wherein the hollow sleeve is bolted to a shoulder of the elongate body.

Embodiment 76: The downhole tool of embodiment 59, wherein the hollow sleeve and elongate body include mating elements restricting rotation of the hollow sleeve relative to the elongate body.

Embodiment 77: The downhole tool of embodiment 76, wherein the mating elements rotationally align the hollow sleeve relative to the elongate body.

Embodiment 78: The downhole tool of embodiment 59, wherein the hollow sleeve is one of a plurality of hollow sleeves of varying dimensions, each hollow sleeve capable of radially encompassing the sleeve receiving section of the elongate body.

Whereas this discussion has referenced the attached drawings, it should be understood that other and further modifications apart from those shown or suggested herein, may be made within the scope and spirit of the present disclosure.

The invention claimed is:

1. A downhole tool, comprising:

an elongate body;

a plate fixed to the body;

an element radially extendable from the plate to an extension radius from an axis of the elongate body;

a gauge cutting element disposed on the plate axially above the element radially extendable from the plate, wherein the gauge cutting element is disposed at a gauge radius greater than the extension radius; and electronics disposed between the plate and the elongate body.

2. The downhole tool of claim 1, wherein the plate is one of a plurality of plates each fixed to the elongate body and spaced circumferentially thereabout.

3. The downhole tool of claim 2, wherein each of the plurality of plates is bolted to at least one other plate through the elongate body.

4. The downhole tool of claim 1, wherein the plate comprises a plurality of gauge cutting elements dispose at a gauge radius greater than the extension radius.

5. The downhole tool of claim 1, comprising a plurality of plates, wherein the plate is one of the plurality of plates, and each plate is capable of being alternatively fixed to the elongate body.

6. The downhole tool of claim 5, wherein each of the plurality of plates comprises at least one cutting element axially above the element radially extendable from the plate and exposed on a leading edge thereof at a cutting radial distance, the cutting radial distance of each of the plurality of plates being unique and greater than the extension radius.

7. The downhole tool of claim 1, wherein the radially-extendable element comprises a piston translatable by pressurized fluid enclosed between the plate and the elongate body.

8. The downhole tool of claim 1, wherein the radially-extendable element comprises at least one cutting element exposed thereon.

9. The downhole tool of claim 1, wherein the electronics are secured to the elongate body.

10. The downhole tool of claim 1, wherein the electronics are capable of wireless communication with the elongate body.

11. The downhole tool of claim 10, wherein the plate is detachable from the elongate body, attachable to a docking station, and the electronics are capable of wireless communication with the docking station when attached thereto.

12. The downhole tool of claim 1, further comprising a valve secured to an exterior of the elongate body.

13. The downhole tool of claim 12, wherein at least a portion of the valve is engaged within the plate.

14. The downhole tool of claim 1, further comprising a nozzle passing from an interior of the elongate body to an exterior thereof.

15. The downhole tool of claim 1, wherein the plate comprises at least one sensor housed therein.

16. The downhole tool of claim 1, wherein the radially-extendable element comprises at least one sensor housed therein.

17. A method, comprising:

selecting a first plate comprising a first radially extendable element and a first gauge cutting element disposed on the first plate axially uphole of the first radially extendable element;

arranging electronics between the first plate and an elongate body of a downhole tool; and fixing the first plate to the elongate body of the downhole tool, wherein the downhole tool comprises a first radial dimension when the first radially extendable element is retracted and a second radial dimension when the first radially extendable element is extended, wherein the downhole tool comprises a first gauge dimension defined by the first gauge cutting element greater than the second radial dimension.

18. The method of claim 17, comprising:

removing the first plate from the elongate body;

selecting a second plate comprising a second radially extendable element and a second gauge cutting element disposed on the second plate axially uphole of the second radially extendable element;

arranging the electronics between the second plate and the elongate body of the downhole tool; and fixing the second plate to the elongate body of the downhole tool, wherein the downhole tool comprises a third radial dimension when the second radially extendable element is retracted and a fourth radial dimension when the second radially extendable element is extended, wherein the third radial dimension is greater than the first radial dimension, and the fourth radial dimension is greater than the second radial dimension, wherein the downhole tool comprises a second gauge dimension defined by the second gauge cutting element greater than the fourth radial dimension.

19. The method of claim 17, comprising:

removing the first plate from the elongate body, wherein the first plate comprises the electronics;

coupling the first plate with a docking station; and communicating wirelessly between the electronics of the first plate and the docking station.

20. The method of claim 17, comprising attaching a plurality of the first plate to be circumferentially spaced about the elongate body of the downhole tool.

* * * * *